US009776217B2

(12) United States Patent
Nakaniwa

(10) Patent No.: US 9,776,217 B2
(45) Date of Patent: Oct. 3, 2017

(54) CENTRIFUGAL COMPRESSOR AND WASHING METHOD

(71) Applicants: MITSUBISHI HEAVY INDUSTRIES, LTD., Tokyo (JP); MITSUBISHI HEAVY INDUSTRIES COMPRESSOR CORPORATION, Tokyo (JP)

(72) Inventor: Akihiro Nakaniwa, Tokyo (JP)

(73) Assignees: MITSUBISHI HEAVY INDUSTRIES, LTD., Tokyo (JP); MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 118 days.

(21) Appl. No.: 14/678,020

(22) Filed: Apr. 3, 2015

(65) Prior Publication Data

US 2015/0224546 A1 Aug. 13, 2015

Related U.S. Application Data

(62) Division of application No. 13/497,634, filed as application No. PCT/JP2011/051610 on Jan. 27, 2011, now Pat. No. 9,194,400.

(30) Foreign Application Priority Data

Jan. 27, 2010 (JP) ..... 2010-015637

(51) Int. Cl.
*B08B 3/00* (2006.01)
*B08B 3/02* (2006.01)
(Continued)

(52) U.S. Cl.
CPC ..... *B08B 3/02* (2013.01); *F04D 17/10* (2013.01); *F04D 17/122* (2013.01); *F04D 29/705* (2013.01)

(58) Field of Classification Search
CPC ..... B08B 3/02; F04D 17/10; F04D 17/122; F04D 29/705
(Continued)

(56) References Cited

U.S. PATENT DOCUMENTS

2008/0120985 A1* 5/2008 Lee ..... F04C 23/001 62/228.1

FOREIGN PATENT DOCUMENTS

JP 55-49049 3/1980
JP 63-212798 9/1988
(Continued)

OTHER PUBLICATIONS

International Search Report issued Apr. 19, 2011 in International (PCT) Application No. PCT/JP2011/051610.
(Continued)

*Primary Examiner* — Eric Golightly
(74) *Attorney, Agent, or Firm* — Wenderoth, Lind & Ponack, L.L.P.

(57) ABSTRACT

The centrifugal compressor is provided with a casing, a rotating shaft which is supported inside the casing, an impeller which is arranged on the rotating shaft and rotates to compress a fluid, and a washing liquid injection device which injects a washing liquid into a flow path formed by the impeller and the casing. The washing liquid injection device is provided with a plurality of nozzles which are arranged along a circumferential direction of the rotating shaft to inject the washing liquid into the flow path and a plurality of chambers which communicate with each corresponding nozzle among the plurality of nozzles and supply the washing liquid to the corresponding nozzle.

7 Claims, 16 Drawing Sheets

(51) Int. Cl.

| | |
|---|---|
| ***F04D 17/10*** | (2006.01) |
| ***F04D 29/70*** | (2006.01) |
| ***F04D 17/12*** | (2006.01) |

(58) Field of Classification Search
USPC ..... 134/174
See application file for complete search history.

(56) References Cited

FOREIGN PATENT DOCUMENTS

| | | |
|---|---|---|
| JP | 63-243497 | 10/1988 |
| JP | 05-141397 | 6/1993 |
| JP | 05-223099 | 8/1993 |
| JP | 06-033899 | 2/1994 |
| JP | 7-127600 | 5/1995 |
| JP | 8-74799 | 3/1996 |
| JP | 08-338397 | 12/1996 |
| JP | 9-220084 | 8/1997 |
| JP | 2918773 | 7/1999 |
| JP | 2003-129997 | 5/2003 |

OTHER PUBLICATIONS

Written Opinion of the International Searching Authority issued Apr. 19, 2011 in International (PCT) Application No. PCT/JP2011/051610.

Japanese Notice of Reasons for Rejection mailed May 7, 2013 in corresponding Japanese Patent Application No. 2009-244516 with English translation.

Japanese Office Action issued Mar. 3, 2015 in corresponding Japanese Patent Application No. 2014-101824 with English translation.

U.S. Patent Office Action issued Mar. 26, 2015 in U.S. Appl. No. 13/497,634.

U.S. Notice of Allowance issued Jul. 17, 2015 in U.S. Appl. No. 13/497,634.

* cited by examiner

CENTRIFUGAL COMPRESSOR AND WASHING METHOD

The application is a division of U.S. patent application Ser. No. 13/497,634, filed on Mar. 22, 2012, and issued as U.S. Pat. No. 9,194,400 on Nov. 24, 2015, and claims the right of priority to Japanese Patent Application No. 2010-015637 filed on Jan. 27, 2010, in Japan, with the content cited herewith.

TECHNICAL FIELD

The present invention relates to a centrifugal compressor which is provided with a washing liquid injection device and also to a washing method which uses the washing liquid injection device of the centrifugal compressor.

BACKGROUND ART

There has been conventionally used a centrifugal compressor for feeding a process gas under pressure in various types of plants. There is a type of centrifugal compressor which injects a washing liquid into a flow path which is formed thereinside.

This type of centrifugal compressor is able to remove dirt and thermal reaction products adhered or deposited on the flow path by using the washing liquid, thus making it possible to recover the performance deteriorated by the adhered or deposited products.

As the above-described centrifugal compressor which injects a washing liquid, there is available, for example, a centrifugal compressor which uses a spray-type nozzle as an injection device for injecting the washing liquid. The injection device is placed, for example, at the top portion of a return vane arranged in a flow path, that is, the injection device is disposed outside in the radial direction of the return vane to atomize the washing liquid and inject the liquid toward the flow path (refer to, for example, Patent Document 1, Patent Document 2, Patent Document 3 and Patent Document 4).

PRIOR ART DOCUMENTS

Patent Documents

Patent Document 1: Japanese Published Unexamined Patent Application No. H05-141397
Patent Document 2: Japanese Published Unexamined Patent Application No. H05-223099
Patent Document 3: Japanese Published Unexamined Patent Application No. H06-33899
Patent Document 4: Japanese Published Unexamined Patent Application No. H08-338397

SUMMARY OF THE INVENTION

Problem to be Solved by the Invention

Incidentally, various types of devices have been arranged in various types of plants, in addition to the centrifugal compressor. In order to prevent erosion of the devices and enhance the energy transfer efficiency, there is often found such a case that a washing liquid contained in a process gas fed under pressure is restricted in amount. In other words, there is often found a case where the washing liquid is restricted in flow rate per unit hour.

In the above-described conventional technology, under such conditions that the washing liquid is restricted in flow rate, the centrifugal compressor is insufficient in the amount of the washing liquid for washing an entire flow path. Thus, it may be difficult to wash the entire flow path completely.

Since the injection device is disposed at the top portion of the return vane (outside in the radial direction of the return vane), the distance between an injection port and the return vane is short and the injected washing liquid soon collides against the return vane and adheres thereto. As a result, there is a case that the flow path is difficult to be washed in its entirety and can only be washed locally.

Further, since a main flow (air flow) which flows through the flow path is extremely large in flow velocity thereof, the washing liquid which has been atomized and sprayed (injected) by the injection device is subjected to shear force by the main flow and further atomized. Then, the atomized washing liquid is decreased in vector toward a direction in which the washing liquid is injected. Thus, the washing liquid is not spread in the injection direction but taken by the main flow to collide against the return vane and soon adheres thereto. As described above, it may be difficult to wash completely the entire flow path.

The present invention is to provide a centrifugal compressor which is capable of efficiently washing an entire flow path under such conditions in which a washing liquid is restricted in flow rate and also to provide a washing method thereof.

Means for Solving the Problem

A first mode of the centrifugal compressor according to the present invention is provided with a casing, a rotating shaft which is supported inside the casing, an impeller which is arranged on the rotating shaft and rotates to compress a fluid, and a washing liquid injection device which injects a washing liquid into a flow path formed by the impeller and the casing. The washing liquid injection device is provided with a plurality of nozzles which are arranged along a circumferential direction of the rotating shaft to inject the washing liquid into the flow path and a plurality of chambers which communicate with each corresponding nozzle among the plurality of nozzles and supply the washing liquid to the corresponding nozzle.

According to the present invention, the washing liquid is supplied selectively to a desired chamber among the plurality of chambers to inject the washing liquid from the nozzle which communicates with the chamber. It is, thereby, possible to wash only a part of the entire flow path which corresponds to a nozzle to which the washing liquid is injected. Then, the above-described procedures are repeated sequentially, thus making it possible to sufficiently wash the entire flow path by using the washing liquid restricted in flow rate.

In the first mode of the centrifugal compressor of the present invention, a flow regulating valve which controls the flow rate of the washing liquid supplied to each of the chambers may be arranged upstream on the opposite side of the nozzle of each of the chambers.

According to the present invention, it is possible to reliably supply the washing liquid restricted in flow rate to a desired chamber. Therefore, it is possible to efficiently wash the entire flow path.

In the first mode of the centrifugal compressor of the present invention, the plurality of chambers may be arranged along the circumferential direction of the rotating shaft in the vicinity of the plurality of nozzles on the casing.

According to the present invention, it is possible to easily set to be similar in distance between each of the chambers and a corresponding nozzle among the plurality of nozzles and also in structure. Thereby, pressure inside the chambers are equalized and the washing liquid injected from each injection port can be made uniform in amount. It is, thus, possible to wash the entire flow path more efficiently.

In the first mode of the centrifugal compressor of the present invention, the plurality of nozzles may be provided on at least one of a diffuser front wall and a diffuser rear wall which form a diffuser in the flow path.

According to the present invention, it is possible to inject the washing liquid from the nozzles so as to intersect with a main flow flowing through the flow path. The injected washing liquid flows temporarily to the other side of an opposing diffuser and spreads in a span direction (a direction of the rotating shaft) between the diffuser front wall and the diffuser rear wall.

At the same time, the washing liquid is atomized by shear force of the main flow flowing through the flow path to spread in the circumferential direction as well and moves into the main flow to flow downstream of the diffuser. Therefore, the injected washing liquid passes a relatively long distance and arrives at the return vane side.

As a result, the washing liquid collides and adheres within a wide range from the diffuser channel, the return channel to the return vane. It is, thereby, possible to reliably wash a desired part of the flow path.

In the first mode of the centrifugal compressor of the present invention, the plurality of nozzles may be arranged in such a manner that the washing liquid can be injected along the axial direction of the rotating shaft.

According to the present invention, the washing liquid injected from the plurality of nozzles favorably flows to the other side of an opposing diffuser along the direction of the rotating shaft. Therefore, the washing liquid spreads more reliably in the span direction (the direction of the rotating shaft) between the diffuser front wall and the diffuser rear wall, thus making it possible to easily wash both walls of the diffuser.

In the first mode of the centrifugal compressor of the present invention, it is acceptable that the plurality of nozzles are constituted with a first nozzle which is arranged on at least one of the diffuser front wall and the diffuser rear wall which form the diffuser in the flow path and formed so as to inject the washing liquid to the other of them and a second nozzle which is arranged outside in the radial direction of the diffuser in the flow path and also along the radial direction and which is formed so as to inject the washing liquid to the diffuser and also formed in such a manner that at least one of the directions at which the washing liquid is injected is the same as the rotating direction of the impeller.

According to the present invention, the washing liquid injected from the first nozzle collides and adheres within a wide range from the diffuser channel, the return channel to the return vane. Therefore, it is possible to reliably wash a desired part of the flow path.

The washing liquid injected from the second nozzle also collides and adheres within a wide range from the diffuser channel, the return channel to the return vane. Therefore, it is possible to more reliably wash a desired part of the flow path.

That is, the second nozzle is arranged outside in the radial direction of the diffuser in the flow path and also along the radial direction and formed so as to inject the washing liquid to the diffuser. Therefore, the washing liquid injected from the plurality of second nozzles flows temporarily inside in the radial direction of the diffuser.

Thereafter, the washing liquid injected from the plurality of second nozzles is pushed back by the main flow flowing through the flow path and flows to the return vane side through a return bend downstream of the diffuser. Thus, the injected washing liquid passes a relatively long distance and arrives at the return vane side.

Further, the second nozzle is formed in such a manner that at least one of the directions at which the washing liquid is injected is the same as the rotating direction of the impeller. Therefore, the washing liquid passes a relatively long distance together with the main flow along the rotating direction of the impeller and arrives at the return vane side. Thereby, the washing liquid collides and adheres within a wide range from the diffuser channel, the return channel to the return vane. It is, therefore, possible to reliably wash a desired part of the flow path.

Therefore, the washing liquid can be injected efficiently in the span direction and the circumferential direction by the first nozzle and the second nozzle to wash a desired part of the flow path more reliably. That is, in the vicinity of an outlet of the impeller, the main flow is greater in flow velocity, for example, on the side of the diffuser rear wall. However, the washing liquid is injected in the span direction (the direction of the rotating shaft), by which the washing liquid spreads more easily in the span direction (the direction of the rotating shaft). On the other hand, since the main flow is relatively slow in flow velocity on the side of the diffuser front wall, the washing liquid spreads more easily in the circumferential direction.

In the first mode of the centrifugal compressor of the present invention, it is acceptable that the first nozzle is arranged on the diffuser rear wall and arranged so as to inject the washing liquid to the diffuser front wall, while the second nozzle is arranged along the diffuser front wall.

In the vicinity of the outlet of the impeller, the main flow is greater in flow velocity on the side of the diffuser rear wall. However, the washing liquid is injected in the span direction (the direction of the rotating shaft), by which the washing liquid spreads more easily in the span direction (the direction of the rotating shaft). On the other hand, since the main flow is relatively slow in flow velocity on the side of the diffuser front wall, the washing liquid spreads more easily in the circumferential direction. Therefore, the washing liquid can be injected efficiently in a wider range in the span direction and the circumferential direction by the first nozzle and the second nozzle. It is, thereby, possible to reliably wash a desired part of the flow path.

The washing method of the present invention is a washing method for removing dirt and thermal reaction products adhered and deposited on the flow path by using the washing liquid injection device arranged on the first mode of the centrifugal compressor of the present invention. The washing method of the present invention includes a washing liquid supplying step which supplies the washing liquid selectively to a desired chamber among the plurality of chambers, a washing liquid injecting step which injects the washing liquid to the flow path via the nozzle which communicates with the chamber to which the washing liquid is supplied by the washing liquid supplying step, and a partial washing step which washes a part of the flow path corresponding to the nozzle through which the washing liquid is injected by the washing liquid injecting step. It is preferable that the washing liquid supplying step, the washing liquid injecting step and the partial washing step are repeated sequentially to wash the entire flow path.

According to the present invention, it is possible to wash sufficiently the entire flow path by using the washing liquid restricted in flow rate.

A second mode of the centrifugal compressor of the present invention is provided with a casing, a rotating shaft which is supported inside the casing, an impeller which is arranged on the rotating shaft and rotates to compress a fluid, and a washing liquid injection device which injects a washing liquid into a flow path formed by the impeller and the casing. The washing liquid injection device is arranged on at least one of a diffuser front wall and a diffuser rear wall which form a diffuser in the flow path to inject the washing liquid to the other of the diffuser front wall and the diffuser rear wall.

According to the present invention, the washing liquid injected from the washing liquid injection device so as to intersect with the main flow flowing through the flow path temporarily flows to the other side of an opposing diffuser and spreads between the diffuser front wall and the diffuser rear wall in the span direction (the direction of the rotating shaft). At the same time, the washing liquid is atomized by shear force of the main flow flowing through the flow path to spread in the circumferential direction as well and moves into the main flow to flow downstream of the diffuser. Therefore, the injected washing liquid passes a relatively long distance and arrives at the return vane side. Then, the washing liquid collides and adheres within a wide range from the diffuser channel, the return channel to the return vane. Thereby, it is possible to wash the flow path over a wide range.

In the second mode of the centrifugal compressor of the present invention, the washing liquid injection device may be arranged so as to inject the washing liquid approximately in parallel with the rotating shaft of the impeller.

According to the present invention, the washing liquid injected from the washing liquid injection device favorably flows along the rotating shaft to the other side of the opposing diffuser. Therefore, the washing liquid spreads more reliably in the span direction (the direction of the rotating shaft) between the diffuser front wall and the diffuser rear wall. Thereby, it is possible to easily wash both walls of the diffuser.

In the second mode of the centrifugal compressor of the present invention, the washing liquid injection device may be provided along the circumferential direction of the rotating shaft with a plurality of nozzles which inject the washing liquid.

According to the present invention, the washing liquid is injected from the plurality of nozzles, by which the washing liquid flows over a wide range in the circumferential direction of the rotating shaft. It is, therefore, possible to wash the flow path over a wide range in the circumferential direction of the rotating shaft as well.

In the second mode of the centrifugal compressor of the present invention, the washing liquid injection device may be provided with a plurality of nozzles which inject the washing liquid and at least one chamber which communicates with each of the nozzles.

According to the present invention, the washing liquid can be supplied to the chamber from a supplying source of the washing liquid, and the washing liquid can be supplied through the common chamber to the nozzles and injected. Therefore, the washing liquid injection device is made simple in structure.

In the second mode of the centrifugal compressor of the present invention, the chamber may be formed approximately in an annular shape so as to surround the rotating shaft.

According to the present invention, the plurality of nozzles are arranged on the chamber formed approximately in the annular shape along the circumferential direction of the rotating shaft. Thereby, the washing liquid is allowed to flow over a wide range in the circumferential direction of the rotating shaft to wash the entire flow path in the circumferential direction of the rotating shaft.

In the second mode of the centrifugal compressor of the present invention, the nozzle may be constituted with an inner circumference nozzle and an outer circumference nozzle which is arranged outside in the radial direction from the inner circumference nozzle.

According to the present invention, where the washing liquid is restricted in feeding amount due to operation conditions of the centrifugal compressor, it is possible to control only one of two systems of the washing liquid injection devices.

The inner circumference nozzle and the outer circumference nozzle may be arranged so as to be different in phase from each other. Further, the bore diameter of the inner circumference nozzle may be formed so as to be smaller than that of the outer circumference nozzle.

In the second mode of the centrifugal compressor of the present invention, the washing liquid injection device may be provided with a first nozzle which is arranged on at least one of the diffuser front wall and the diffuser rear wall which form the diffuser in the flow path and which is arranged so as to inject the washing liquid toward the other of the diffuser front wall and the diffuser rear wall and a second nozzle which is arranged outside in the radial direction of the diffuser toward the inside in the radial direction of the diffuser in the flow path and which is arranged in such a manner that at least one of the directions at which the washing liquid is injected is the same as the rotating direction of the impeller and also intersects approximately at right angles in a direction at which the fluid flows in a right-angled cross section of the rotating shaft at a position of the impeller opposing the washing liquid injection device.

As described above, the washing liquid injected from the first nozzle collides and adheres within a wide range from the diffuser channel, the return channel to the return vane. Thereby, the flow path can be washed over a wide range.

Further, the washing liquid injected from the second nozzle also collides and adheres within a wide range from the diffuser channel, the return channel to the return vane. It is, thereby, possible to wash the flow path over a wide range.

That is, the second nozzle is arranged outside in the radial direction of the diffuser toward the inside in the radial direction of the diffuser in the flow path. Therefore, the washing liquid injected from the washing liquid injection device temporarily flows inside in the radial direction of the diffuser. Thereafter, the washing liquid is pushed back by a main flow flowing through the flow path, passes through a return bend downstream of the diffuser and flows to the return vane side. Therefore, the injected washing liquid passes a relatively long distance and arrives at the return vane side.

Further, a direction in which the washing liquid is injected is the same as the rotating direction of the impeller and also this direction is to intersect approximately at right angles in a direction at which the fluid flows in a right-angled cross section of the rotating shaft at a position of the impeller opposing the washing liquid injection device. Therefore, the washing liquid moves into the main flow along the rotating direction of the impeller, and arrives at the return vane side through the relatively long distance described above. Thereby, the washing liquid collides and adheres within a wide range from the diffuser channel, the return channel to the return vane as described above. It is, thereby, possible to wash the flow path over a wide range.

Therefore, the washing liquid injected from the first nozzle and the second nozzle can be injected efficiently in the span direction and the circumferential direction. In addition, the flow path can be washed over a wider range. That is, in the vicinity of the outlet of the impeller, the main flow is greater in flow velocity, for example, on the diffuser rear wall. The washing liquid injected from the first nozzle is accordingly atomized in an accelerated manner and spreads more easily in the span direction (the direction of the rotating shaft). On the other hand, the main flow is relatively slow in flow velocity on the diffuser front wall and the washing liquid spreads more easily in the circumferential direction.

In the second mode of the centrifugal compressor of the present invention, it is acceptable that the first nozzle is arranged on the diffuser rear wall and also arranged so as to inject the washing liquid to the diffuser front wall and the second nozzle is arranged along the diffuser front wall.

In the vicinity of the outlet of the impeller, the main flow is greater in flow velocity on the diffuser rear wall. Thus, the washing liquid injected from the first nozzle is atomized accordingly in an accelerated manner and spreads more easily in the span direction (the direction of the rotating shaft). On the other hand, the main flow is relatively slow in flow velocity on the diffuser front wall and the washing liquid spreads more easily in the circumferential direction. Therefore, the washing liquid can be injected and spread efficiently in the span direction and the circumferential direction by the first nozzle and the second nozzle. It is, thereby, possible to wash the flow path over a wide range.

Advantageous Effect of the Invention

According to the present invention, the washing liquid is supplied selectively to any one of the plurality of chambers to inject the washing liquid from a nozzle communicating with the chamber concerned, thus making it possible to wash only a part of the entire flow path corresponding to a nozzle through which the washing liquid is injected. The above procedures are repeated sequentially, by which the washing liquid restricted in flow rate can be used to sufficiently wash the entire flow path.

According to the invention as claimed in the application concerned, the washing liquid collides and adheres within a wide range from the diffuser channel, the return channel to the return vane. It is, thereby, possible to wash efficiently within a wide range of the entire flow path.

BRIEF DESCRIPTION OF THE DRAWINGS

FIG. 6 (*b*) is a view which explains the other mode of FIG. 6 (*a*).

FIG. 14 (*a*) is a cross sectional view and FIG. 14 (*b*) is a cross sectional view taken along the line E to E in FIG. 14 (*a*).

MODE FOR CARRYING OUT THE INVENTION

First Embodiment

Centrifugal Compressor

Next, an explanation will be made for the first embodiment of the present invention by referring to FIG. 1 to FIG.

8. In the following drawings to be explained hereinafter, individual members are changed in scale, whenever necessary, so as to dimensionally recognize them.

Figure 1:
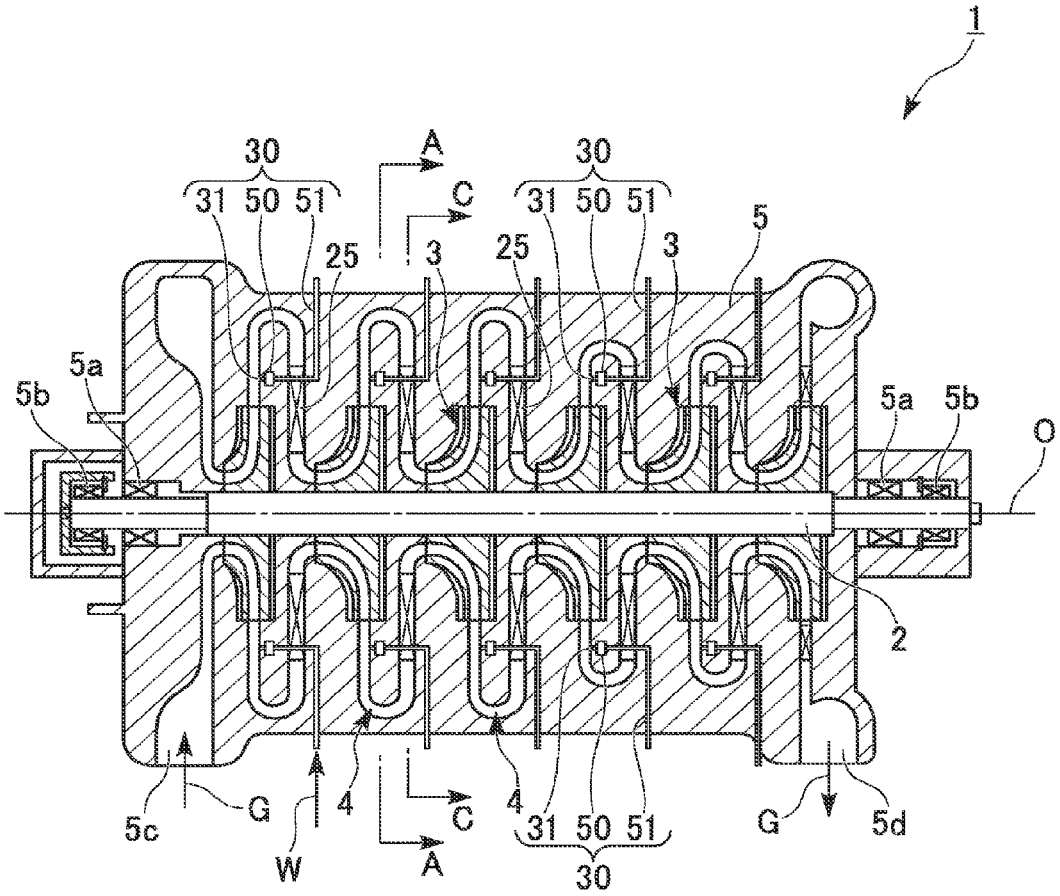
FIG. 1 is a sectional side view of a centrifugal compressor of a first embodiment of the present invention when viewed in a direction perpendicular to a rotating shaft.

FIG. 1 is a schematic block diagram of a centrifugal compressor 1.

As shown in the view, the centrifugal compressor 1 is a multiple-stage centrifugal compressor having six impellers. The centrifugal compressor 1 is provided with a shaft (rotating shaft) 2 which is rotated around the axis line O, an impeller 3 which is arranged on the shaft 2 to compress a process gas (gaseous substance) G by utilizing centrifugal force and a casing 5 which rotatably supports the shaft 2 and has a flow path 4 which allows the process gas G to flow from upstream to downstream. The centrifugal compressor 1 is also provided with a washing liquid injection device 30 which injects a washing liquid into the flow path 4.

The casing 5 is formed so as to give an approximately columnar outer configuration in which the shaft 2 is arranged so as to penetrate through the center. A journal bearing 5*a* and a thrust bearing 5*b* are respectively arranged on both sides of the casing 5, thereby rotatably supporting the shaft 2. In other words, the shaft 2 is supported by the casing 5 via the journal bearing 5*a* and the thrust bearing 5*b*.

Further, an intake port 5*c* through which the process gas G flows from outside is arranged at one end of the casing 5, whereas a discharge port 5*d* is arranged at the other end thereof through which the process gas G flows outside. An inner space which communicates with the intake port 5*c* and the discharge port 5*d* to repeat reduction and expansion of the diameter is provided inside the casing 5.

The inner space functions not only as a space for accommodating the impeller 3 but also as a flow path 4. In other words, the intake port 5*c* and the discharge port 5*d* communicate with each other via the impeller 3 and the flow path 4.

Figure 2:
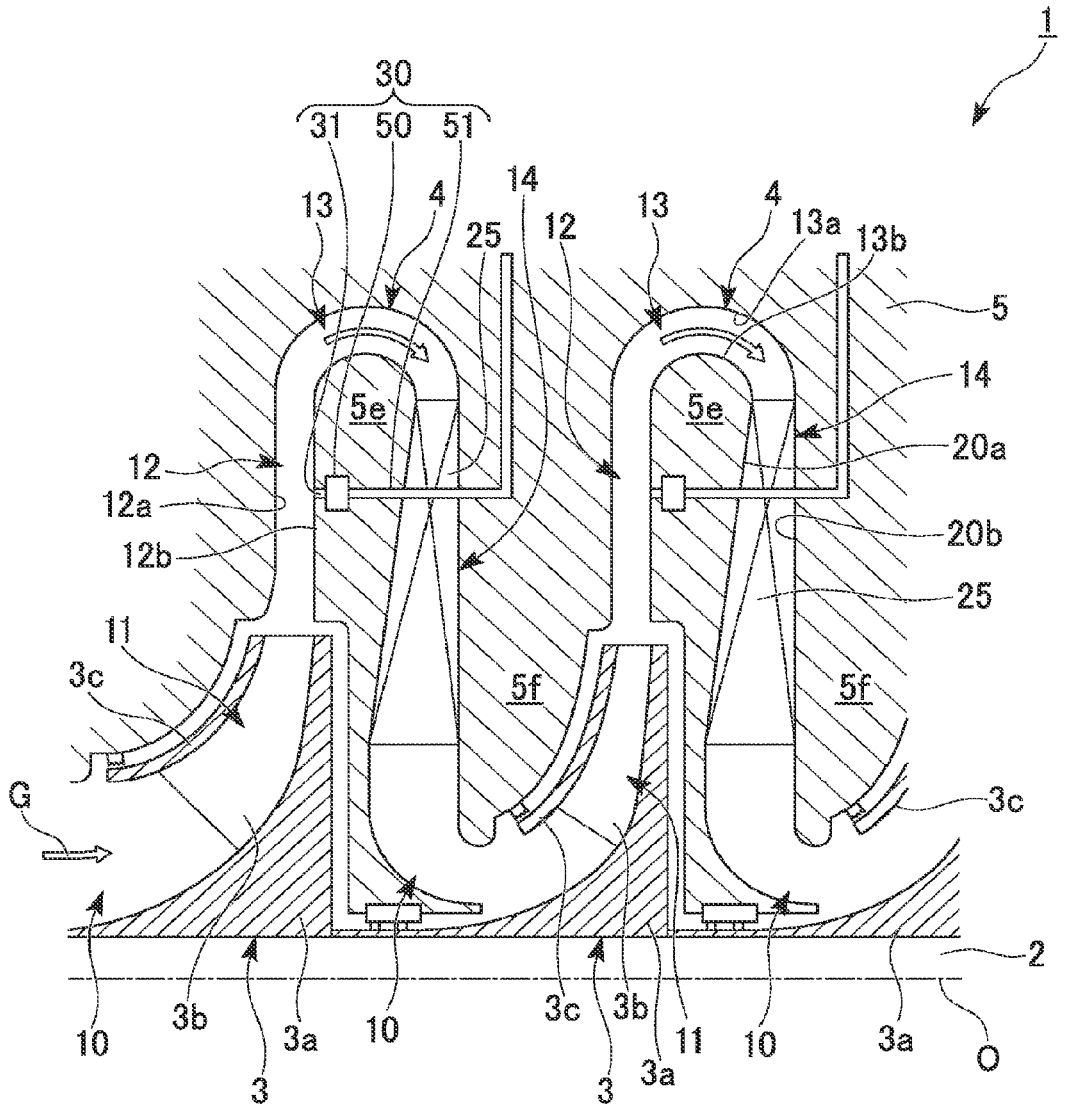
FIG. 2 is an enlarged view of major parts shown in FIG. 1.

FIG. 2 is an enlarged view of major parts shown in FIG. 1.

As shown in FIG. 1 and FIG. 2, these six impellers 3 are arranged at intervals in the axial direction of the shaft 2. Each of the impellers 3 is substantially constituted with an approximately circular-disk shaped hub 3*a* which is increased in diameter as moving to the discharge port 5*d* side, a plurality of blades 3*b* which are attached to the hub 3*a* in a radial pattern and arrayed in the circumferential direction, and a shroud 3*c* which is attached so as to cover the leading end of each of the plurality of blades 3*b* in the circumferential direction.

FIG. 2 shows a periphery of the impellers 3 at the first stage and the second stage.

The flow path 4 is formed so as to connect between each of the impellers 3 by which the process gas G can be compressed in a stepwise manner.

To be more specific, the flow path 4 is substantially constituted with a suction channel 10, a compression channel 11, a diffuser channel (diffuser) 12, a return bend channel (return bend) 13, and a return channel 14.

The suction channel 10 is a channel which allows the process gas G to flow from outside in the radial direction to inside in the radial direction and thereafter changes a direction of the process gas G to the axial direction of the shaft 2 immediately before the impeller 3. To be more specific, the suction channel 10 is provided with the return channel 14 to be described later.

The compression channel 11 is a channel which is surrounded with a blade-attaching face of the hub 3*a* and an inner wall face of the shroud 3*c* to compress the process gas G fed from the suction channel 10 inside the impeller 3.

The diffuser channel (diffuser) 12 is a channel which is surrounded with a diffuser front wall 12*a* of the casing 5 and a diffuser rear wall 12*b* of a partition member 5*e*. Additionally, the inside in the radial direction of the diffuser channel communicates with the compression channel 11. The diffuser channel 12 allows the process gas G compressed by the impeller 3 to flow outside in the radial direction. Then, the washing liquid injection device 30 to be described later is arranged on the diffuser rear wall 12*b* of the diffuser channel 12.

The return channel 14 communicates with the outside in the radial direction of the diffuser channel 12 via the return bend channel 13. However, the diffuser channel 12 which leads to the impeller 3 at a sixth stage communicates with the discharge port 5*d*.

Further, there may be arranged on the diffuser channel 12 a plurality of diffuser vanes (not illustrated) which are arranged so as to be arrayed in a radial pattern in the circumferential direction around the center of the axis line O.

The return bend channel 13 is a curved channel (a flow path) which is surrounded with an inverted wall 13*a* of the casing 5 and an outer circumference wall 13*b* of the partition member 5*e*. In the return bend channel 13, one end thereof communicates with the diffuser channel 12, whereas the other end thereof communicates with the return channel 14. The return bend channel 13 inverts the process gas G which flows outside in the radial direction through the diffuser channel 12 so as to face inside in the radial direction, thereby feeding the process gas G to the return channel 14.

A border between the diffuser channel 12 and the return bend channel 13 is a border between a part extending linearly and a curved part in FIG. 2. Therefore, the linearly extending part is given as the diffuser channel 12, whereas the curved part is given as the return bend channel 13.

The return channel 14 which constitutes a part of the suction channel 10 as described above is a channel which is surrounded with a downstream side wall 20*a* of the partition member 5*e* integrally attached to the casing 5 and an upstream side wall 20*b* of the extension portion 5*f* integrally attached to the casing 5 and extending in the radial direction. The return channel 14 communicates with the other end of the return bend channel 13 outside in the radial direction. However, the suction channel 10 which feeds the process gas G into the impeller 3 at the first stage communicates with the intake port 5*c* outside in the radial direction.

Further, there are arranged on the return channel 14 a plurality of return vanes 25 which are arranged so as to be arrayed in a radial pattern in the circumferential direction around the center of the axis line O. A border between the return channel 14 and the return bend channel 13 is a border between the linearly extending part and the curve part in FIG. 2. Therefore, the linearly extending part is given as the return channel 14, whereas the curved part is given as the return bend channel 13.

In the above-described constitution, the process gas G flows from the intake port 5*c* into the flow path 4, flowing sequentially from the suction channel 10 (including the return channel 14) of the impeller 3 at the first stage, the compression channel 11, the diffuser channel 12, and to the return bend channel 13. Thereafter, the process gas G flows further through the suction channel 10 (the return channel 14) of the impeller 3 at the second stage, the compression channel 11, and so forth.

Then, the process gas G which has flown down to the diffuser channel 12 of the impeller 3 at the sixth stage flows outside from the discharge port 5*d*.

Further, the process gas G is compressed by each of the impellers 3 while flowing in accordance with the above order. In other words, in the centrifugal compressor 1 of the present embodiment, the process gas G is compressed in a stepwise manner by the six impellers 3, thereby obtaining a large compression ratio.

In this case, the centrifugal compressor 1 is provided on the diffuser rear wall 12*b* of the diffuser channel 12 with the washing liquid injection device 30.

(Washing Liquid Injection Device)

Figure 3:
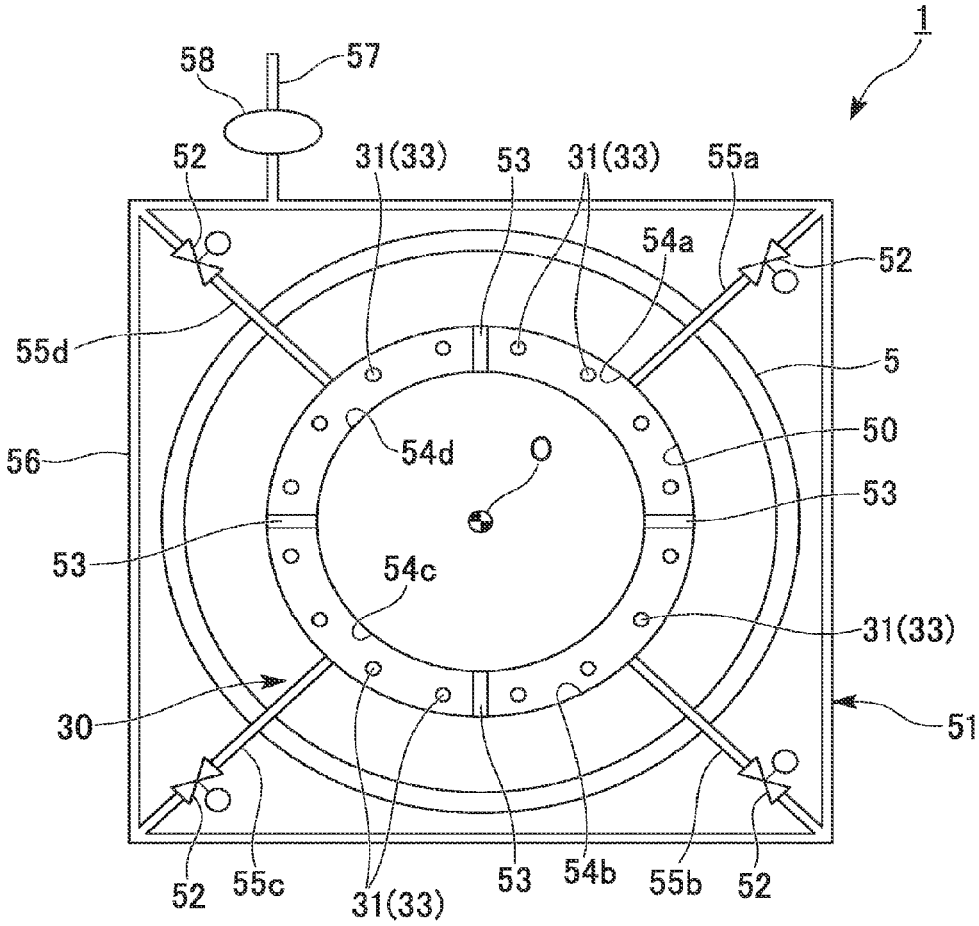
FIG. 3 is a cross sectional view taken along the line A to A in FIG. 1.
Figure 4:
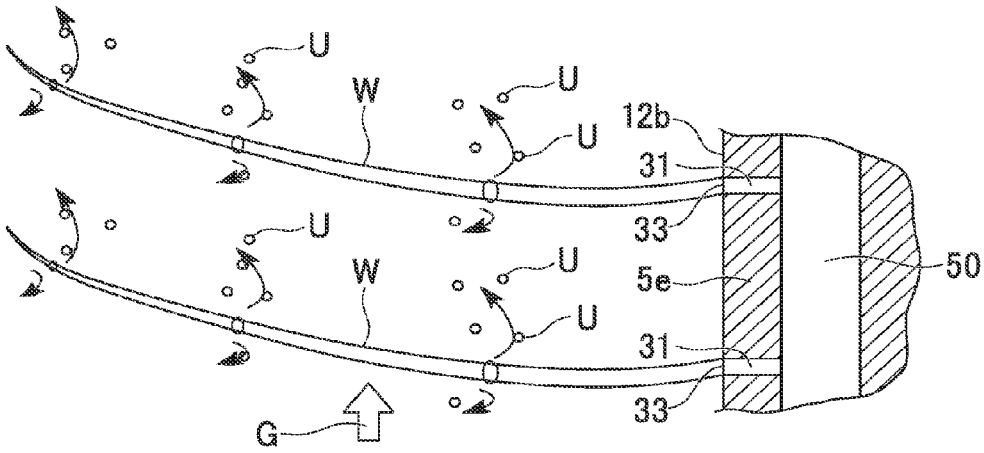
FIG. 4 is a schematic view which shows an operation state of a washing liquid injection device of the first embodiment of the present invention FIGS. 5 (*a*)-5 (*c*) cover a brief constitution of a nozzle of the first embodiment of the present invention. More specifically, FIG. 5 (*a*) is a schematic cross sectional view, FIG. 5 (*b*) is a cross sectional view taken along the line B to B in FIG. 5 (*a*), and FIG. 5 (*c*) is a schematic cross sectional view which shows the other mode.

FIG. 3 is a cross sectional view taken along the line A to A in FIG. 1. FIG. 4 is a schematic view which shows an operating state of the washing liquid injection device 30. It is noted that description of the shaft 2 is omitted in FIG. 3.

As shown in FIG. 1 to FIG. 4, the washing liquid injection device 30 is provided with a plurality of nozzles 31 (16 nozzles, for example, in the first embodiment) for injecting a washing liquid W, a chamber 50 which communicates with each of the nozzles 31, a washing liquid supplying source (not illustrated) for supplying the washing liquid W to the chamber 50 via a pipe 51, and a flow regulating valve 52 arranged along the pipe 51.

The plurality of nozzles 31 are arranged (arrayed) along the circumferential direction of the impeller 3 in a concentric fashion with respect to an outer circumference of the impeller 3. These nozzles 31 are arranged at regular intervals in the circumferential direction of the impeller 3 and arranged in such a manner that a washing liquid injection port (a nozzle port 33) is substantially flush with the inner wall face of the diffuser rear wall 12*b*. There are provided as many nozzles 31 as the return vanes 25, for example.

As described above, where the nozzles 31 which are as many as the return vanes 25 are arrayed along the circumferential direction of the impeller 3, it is only necessary for one of the nozzles 31 to inject washing liquid to a part between mutually adjacent blades at such a position that corresponds to the return vane 25. As a result, there is eliminated a necessity for expanding the washing liquid W injected from the nozzle 31 in the circumferential direction inside the flow path, and the washing liquid can be expanded accordingly in the span direction.

The chamber 50 is a flow path or a tube body which is formed approximately annularly so as to surround the impeller 3 and the shaft (rotating shaft) 2 and arranged inside the partition member 5*e* of the casing 5. Then, the nozzle 31 is arranged from the chamber 50 to an inner wall face of the diffuser rear wall 12*b* so as to be orthogonal to the inner wall face. In other words, the chamber 50 is arranged in the vicinity of the nozzle 31.

Further, four partitions 53 are arranged inside the chamber 50 at regular intervals in the circumferential direction. That is, the chamber 50 is demarcated by the four partitions 53 into four divided chambers 54*a*, 54*b*, 54*c*, 54*d*.

Each of the nozzles 31 communicates with each of the corresponding divided chambers 54*a* to 54*d*. In other words, in the first embodiment, each of the four nozzles 31 which are adjacent in the circumferential direction communicates with one of the corresponding four divided chambers 54*a* to 54*d*.

Here, a detailed explanation will be made for the nozzle 31 by referring to FIG. 4, FIG. 5(*a*), FIG. 5(*b*), and FIG. 5(*c*).

Figure 5A:
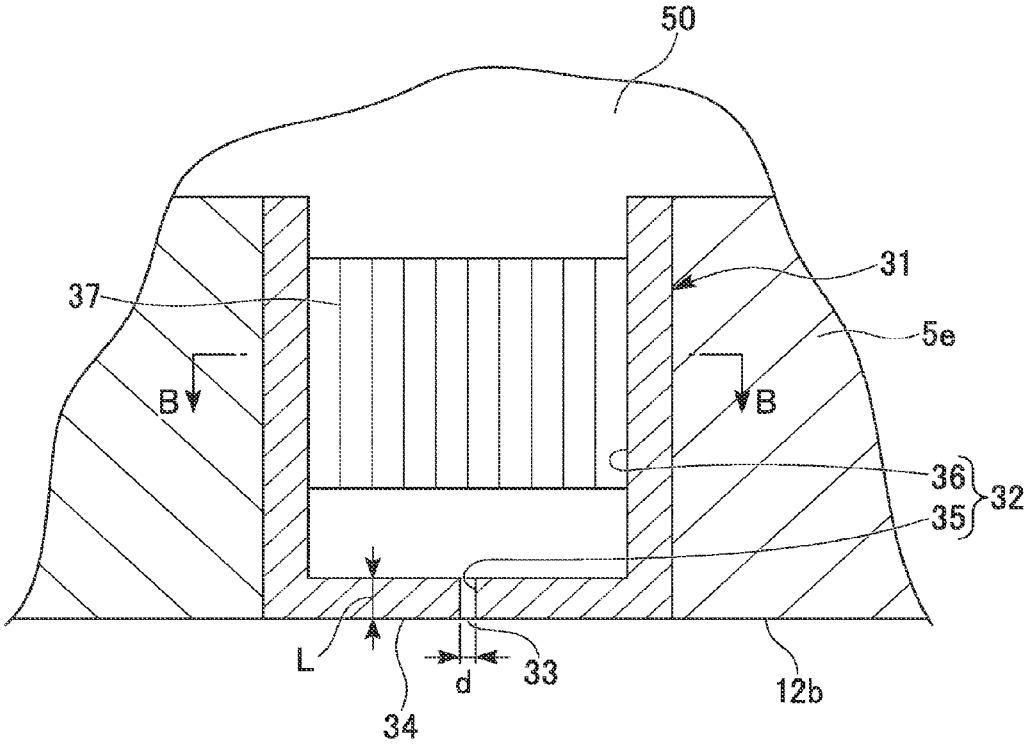
Figure 5B:
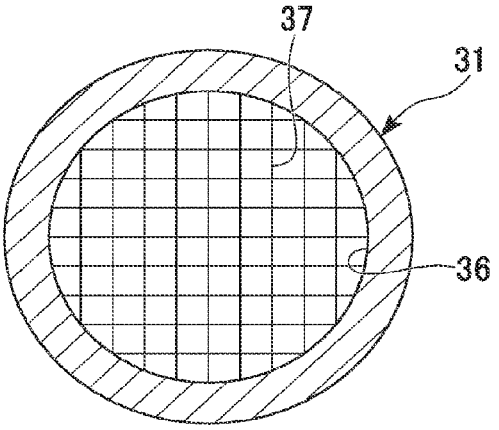
Figure 5:
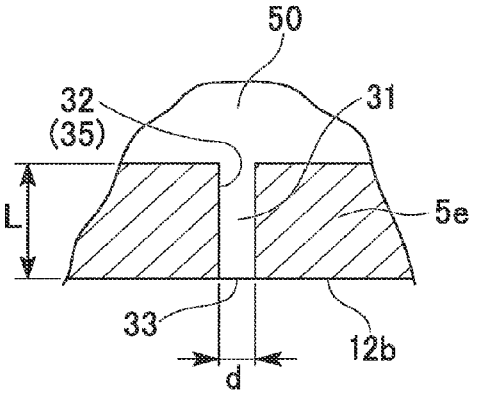

FIG. 5 shows a schematic structure of the nozzle 31. More specifically, (a) is a schematic cross sectional view, (b) is a cross sectional view taken along the line B to B in (a), and (c) is a schematic cross sectional view which shows the other mode.

As shown in FIG. 5(*a*), the nozzle 31 is provided with an inner hole 32 which leads to a washing liquid supplying source (not illustrated) and a nozzle port 33 which communicates with the inner hole 32 to inject the washing liquid W. Then, the nozzle 31 is arranged approximately in parallel with the shaft (rotating shaft) 2 from the diffuser rear wall 12*b* to the diffuser front wall 12*a* so as to inject the washing liquid W into the diffuser channel 12.

The inner hole 32 is provided with a linear rectifying portion 35 formed on the same inner diameter side as the nozzle port 33, with the nozzle port 33 formed on a leading end face 34 of the nozzle 31 given as an opening end, and a large diameter portion 36 which communicates with the rectifying portion 35 and is formed so as to be larger in inner diameter than the rectifying portion 35.

The rectifying portion 35 is set in such a manner that a flow path length L thereof is at least three times the inner diameter d of the nozzle port 33.

To be more specific, the inner diameter d of the nozzle port 33 is set from about 0.1 mm to about 10 mm and more preferably from 1 mm or greater to 5 mm or less. As described above, there is provided the rectifying portion 35 having a flow path length which is at least three times the inner diameter d of the nozzle port 33. Thereby, the washing liquid W injected from the nozzle 31 flows in a continuous liquid columnar shape as shown in FIG. 4.

That is, the washing liquid W which flows through the inner hole 32 of the nozzle 31 is injected from the nozzle port 33 in a state of being rectified by the rectifying portion 35. Thereby, substantially no gyration vector is imparted to the injected washing liquid W.

Therefore, as shown in FIG. 4, the injected washing liquid W flows in a continuous liquid columnar shape without causing atomization by disrupted flow of the washing liquid by the gyration vector. However, the washing liquid W is injected in a liquid columnar shape and, thereafter, subjected to shear force by the flow of a main flow (flow of the process gas G). Thereby, some of the washing liquid is atomized to develop gradually into atomized droplets U.

Further, as shown in FIG. 5(*a*), it is preferable that the large diameter portion 36 is provided with a rectifying plate 37.

As shown in FIG. 5(*b*), the rectifying plate 37 is that which is constituted with many plates arranged vertically and horizontally to give a lattice structure. It is noted that the length of one side of a square formed between the plates arranged vertically and horizontally is set to be greater than the inner diameter d of the nozzle port 33.

The rectifying plate 37 is arranged at the large diameter portion 36, by which no gyration vector is imparted but only a direct vector is imparted to the washing liquid W which flows into the rectifying portion 35.

Therefore, the washing liquid W injected from the nozzle 31 continues more favorably after flowing further through the rectifying portion 35 and forms into a liquid columnar shape as shown in FIG. 4.

The above-constituted nozzle 31 is able to inject the washing liquid W over a wider range in the span direction from the diffuser rear wall 12*b* to the diffuser front wall 12*a*.

As shown in FIG. 5(*c*), the present invention shall not be restricted to formation of the inner hole 32 with the rectifying portion 35 and the large diameter portion 36 but may include a case where the inner hole 32 formed only by the rectifying portion 35 is given as the nozzle 31 to make a hole directly on an inner wall face of the diffuser rear wall 12*b*. In this case, the wall thickness sectioned by the inner wall face of the diffuser rear wall 12*b* and the chamber 50 is given as the flow path length L, and the flow path length L is formed so as to be at least three times the inner diameter d of the nozzle port 33. The thus obtained sufficient rectifying effects make it possible that the washing liquid W injected from the nozzle 31 is made into a favorably continuing liquid columnar shape.

Figure 6:
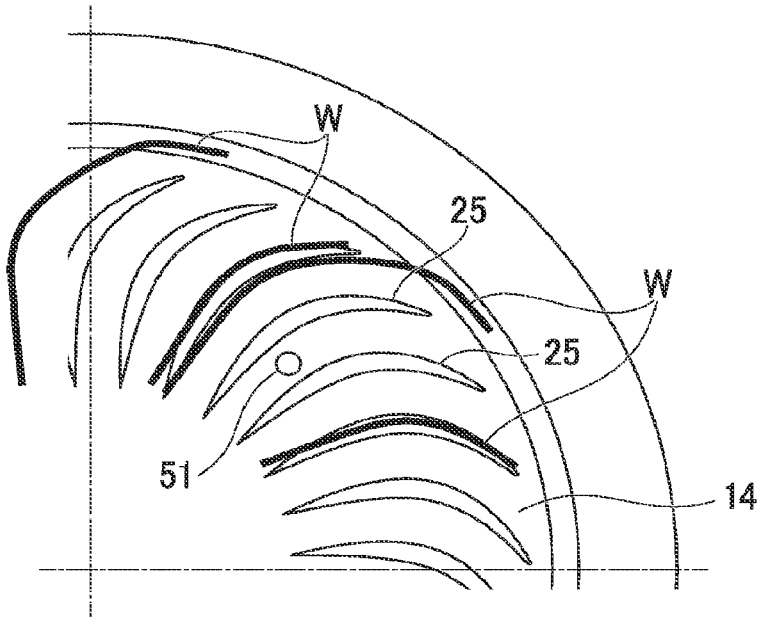
FIGS. 6 (*a*) and 6 (*b*) are cross sectional views taken along the line C to C in FIG. 1.
Figure 6:
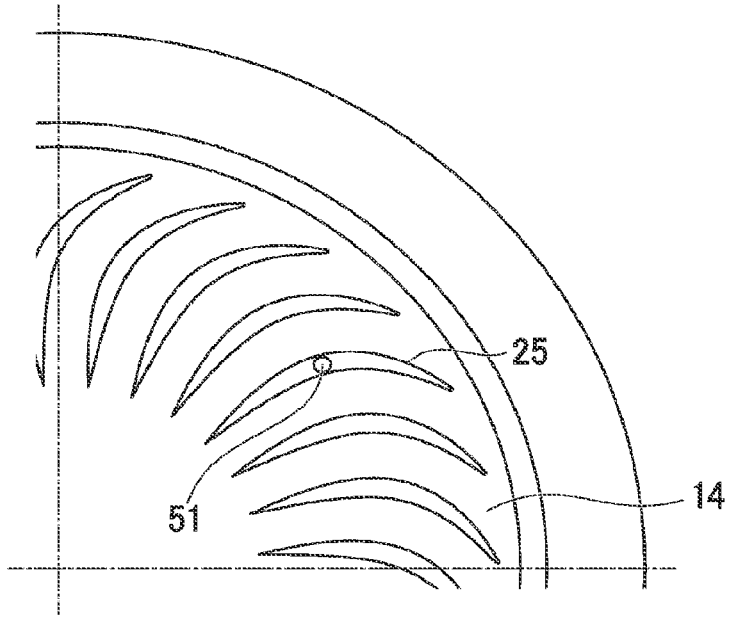

FIG. 6(*a*) is a cross sectional view taken along the line C to C in FIG. 1 and FIG. 6(*b*) is a view which explains the other mode of FIG. 6(*a*).

As shown in FIG. 1 to FIG. 3 as well as FIG. 6(*a*) and FIG. 6(*b*), the pipe 51 is provided with branching pipes 55*a* to 55*d*, one end of each of which is connected to each of the divided chambers 54*a* to 54*d* of the chamber 50 and a coupling pipe 56 which is connected to the other end of each of the branching pipes 55*a* to 55*d* to couple each of the branching pipes 55*a* to 55*d*.

Each of the branching pipes 55*a* to 55*d* penetrates between the return vanes 25, 25 arranged inside the return channel 14, passes through the extension portion 5*f* and is drawn outside the casing 5. Alternatively, each of the branching pipes 55*a* to 55*d* may be formed so as to penetrate the return bend channel 13 in stead of penetrating the return channel 14.

However, where each of the branching pipes 55*a* to 55*d* is made intersected inside the return channel 14, as shown in FIG. 6(*a*), each of them is not allowed to penetrate between the return vanes 25, 25 but, as shown in FIG. 6(*b*), each of them may be allowed to penetrate the return vane 25. Accordingly, it is possible to eliminate an influence of each of the branching pipes 55*a* to 55*d* on the main flow. Further, In this case, a through hole formed inside the return vane 25 may be used as a flow path in stead of each of the branching pipes 55*a* to 55*d* at this part.

Further, the flow regulating valve 52 is arranged on each of the branching pipes 55*a* to 55*d*. In other words, each of the divided chambers 54*a* to 54*d* is provided with the flow regulating valve 52 on a washing liquid supplying source side (not illustrated) which is upstream opposing each of the nozzles 31. The flow regulating valve 52 regulates a flow rate of the washing liquid W which is supplied to each of the divided chambers 54*a* to 54*d* of the chamber 50 on the basis of a signal from a controller (not illustrated). Each of the flow regulating valves 52 is electrically connected to the controller (not illustrated).

The washing liquid supplying source (not illustrated) is connected via a bypass 57 to a part of the coupling pipe 56 which couples the other end of each of the branching pipes 55*a* to 55*d*. That is, the coupling pipe 56 functions to distribute the washing liquid W supplied from the washing liquid supplying source to each of the branching pipes 55*a* to 55*d*.

The bypass 57 is provided with a feed pump 58 for feeding out the washing liquid W of the washing liquid supplying source to the coupling pipe 56. The feed pump 58 is actuated on the basis of a signal from the controller (not illustrated), by which the washing liquid W of the washing liquid supplying source is fed to the coupling pipe 56 via the bypass 57.

(Washing Method)

Next, an explanation will be made for a washing method using the washing liquid injection device 30 by referring to FIG. 2 to FIG. 4 and FIG. 7.

Figure 7:
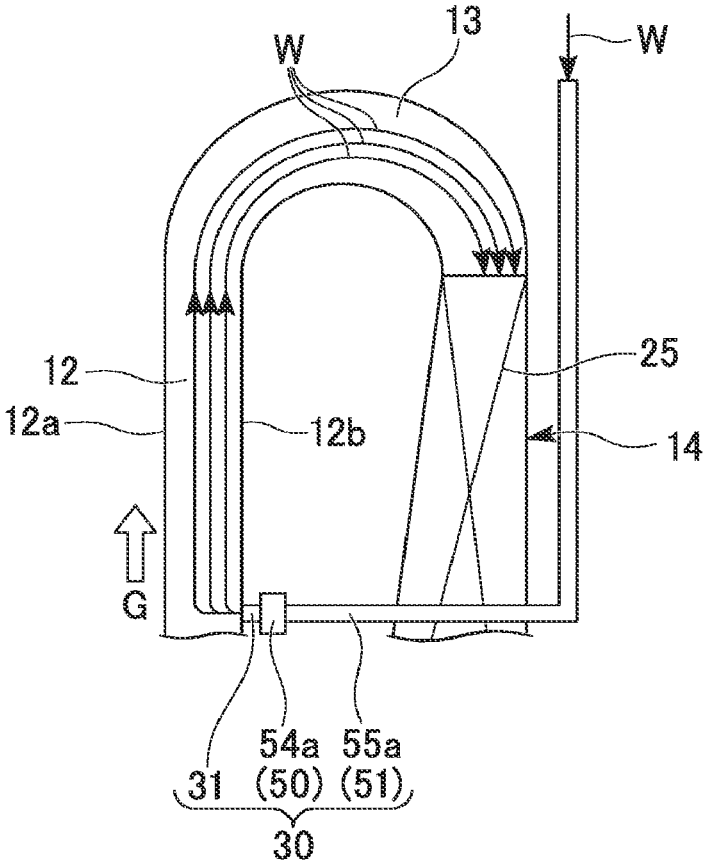
FIG. 7 is a schematic view which shows a state of a washing liquid of the first embodiment of the present invention.

FIG. 7 is a schematic view which shows a state that the washing liquid W flows through the flow path 4. In FIG. 7, the behaviors of the washing liquid W injected via each of the divided chambers 54*a* to 54*d* are similar to each other. Therefore, there is only shown a state that the washing liquid W injected via the divided chamber 54*a* flows through the flow path 4. In addition, omitted is a schematic view which shows a state that the washing liquid W injected via each of the other divided chambers 54*b* to 54*d* flows through the flow path 4.

As shown in FIG. 2, FIG. 3, and FIG. 7, upon injection of the washing liquid W from the nozzle 31 of the washing liquid injection device 30, first, among the branching pipes 55*a* to 55*d* connected to the four divided chambers 54*a* to 54*d* of the chamber 50, any given branching pipes, for example, the flow regulating valve 52 attached to the branching pipe 55*a* is opened, while the flow regulating valves 52 attached to other branching pipes, for example, the branching pipes 55*b* to 55*d* are shut off.

When the feed pump 58 is actuated in the above-described state, the washing liquid W supplied from the washing liquid supplying source (not illustrated) circulates through only the branching pipe 55*a* connected to the divided chamber 54*a*, among the four divided chambers 54*a* to 54*d*. Then, the washing liquid W is filled into the divided chamber 54*a* (washing liquid supplying step).

When the washing liquid W is filled into the divided chamber 54*a*, the washing liquid W is injected from the divided chamber 54*a* via the nozzle 31 (washing liquid injecting step).

In this case, the nozzle 31 is arranged on the diffuser rear wall 12*b* and also arranged so as to inject the washing liquid W to the diffuser front wall 12*a*. Therefore, the washing liquid W temporarily flows along the length direction of the shaft 2 (the direction of the rotating shaft) toward the opposite side of the diffuser channel 12 and spreads in the span direction (the direction of the rotating shaft) between the diffuser rear wall 12*b* and the diffuser front wall 12*a* (refer to FIG. 4).

Further, as shown in FIG. 4 and FIG. 7, the washing liquid W injected from the nozzle port 33 temporarily spreads in the span direction of the diffuser channel 12. Thereafter, the washing liquid W is flown downstream of the diffuser channel 12 by the main flow (the process gas G) flowing through the diffuser channel 12. Thus, the injected washing liquid W passes a relatively long distance and arrives at the return channel 14 side.

Then, the washing liquid W is subjected to shear force resulting from the flow of the main flow (flow of the process gas G) and atomized gradually to develop into droplets U. Out of the diffuser channel 12 and the return bend channel 13, at a site corresponding to the divided chamber 54*a* of the chamber 50, in other words, out of the inner wall faces of the diffuser channel 12 and the return bend channel 13, on about ¼ of the inner wall face, the washing liquid W collides and adheres to wash the inner face thereof. Further, the washing liquid W moves into the flow of the main flow and arrives at the return channel 14 and the return vane 25 side. Thereafter, out of the blade face of the return vane 25 and the return channel 14, at a site corresponding to the divided chamber 54*a* of the chamber 50, in other words, out of the blade face of the return vane 25 and the inner wall face of the return channel 14, on about ¼ of the inner wall face, the washing liquid W collides and adheres to wash the inner wall face thereof (partial washing step).

After completion of the partial washing step, the flow regulating valve 52 attached to the branching pipe 55*a* is shut off, and the flow regulating valve 52 attached to the branching pipe 55*b* which is, for example, one of the other branching pipes 55*b* to 55*d* is opened. Then, after the above-described washing liquid supplying step and the washing liquid injecting step, out of the diffuser channel 12 and the return bend channel 13, a site corresponding to the divided chamber 54*b* of the chamber 50 is washed. In addition, out of the blade face of the return vane 25 and the return channel 14, a site corresponding to the divided chamber 54*b* of the chamber 50 is washed.

Then, the above procedures are repeated sequentially for the divided chambers 54*c*, 54*d* of each of the chambers 50. It is, thereby, possible to reliably wash the entire flow path over a wide range from the diffuser channel 12, the return channel 14 to the return vane 25.

In this case, opening and closing actions and adjustment of opening degree of the flow regulating valve 52 attached to each of the branching pipes 55*a* to 55*d* are carried out on the basis of a signal from the controller (not illustrated).

(Effect)

Therefore, according to the above-described first embodiment, the chamber 50 is demarcated into four divided chambers 54*a* to 54*d* by the partition 53. Thus, even where the washing liquid W from a washing liquid supplying source (not illustrated) is restricted in supplying amount, it is possible to sequentially wash limited ranges of the flow path 4, that is, sites corresponding to the diffuser channel 12, the return channel 14 and each of the divided chambers 54*a* to 54*d* of the return vane 25. It is, thereby, possible to reliably wash the diffuser channel 12, the return channel 14 and the return vane 25 entirely.

Further, the flow regulating valve 52 is attached to each of the branching pipes 55*a* to 55*d*. Therefore, the flow regulating valve 52 can be controlled to reliably supply the washing liquid W only to any desired divided chambers 54*a* to 54*d*. Thus, it is possible to efficiently wash the entire flow path by using the washing liquid W restricted in supply amount.

Still further, the chamber 50 is arranged inside the partition member 5*e* of the casing 5, and also the nozzle 31 is arranged from the chamber 50 to an inner wall face of the diffuser rear wall 12*b* so as to be orthogonal to the inner wall face. It is, therefore, possible to set to be substantially similar in structure and distance from each of the chambers 50 to each of the corresponding plurality of nozzle ports 33. Then, it is possible to equalize the pressure inside the chamber 50 and also make constant an amount of the washing liquid injected from each of the nozzle ports 33. Thus, the flow path can be washed more efficiently in its entirety.

In this case, the washing liquid W is temporarily filled into the divided chambers 54*a* to 54*d* and injected through the nozzle 31. Thereby, it is possible to make pressure substantially constant downstream from the divided chambers 54*a* to 54*d*, in other words, over a range from the feed pump 58 to each of the divided chambers 54*a* to 54*d*. In addition, the washing liquid W can be uniformly injected from a washing hole disposed on the chamber. Therefore, it is possible to more efficiently wash the diffuser channel 12, the return channel 14 and the return vane 25 entirely.

Further, the washing liquid W is injected approximately in parallel with the shaft (rotating shaft) 2, by which the washing liquid W flows favorably along the length direction of the shaft 2 toward the opposite side of the diffuser channel 12. Therefore, the washing liquid W can be sufficiently spread in the span direction between the diffuser front wall 12*a* and the diffuser rear wall 12*b*.

Figure 8:
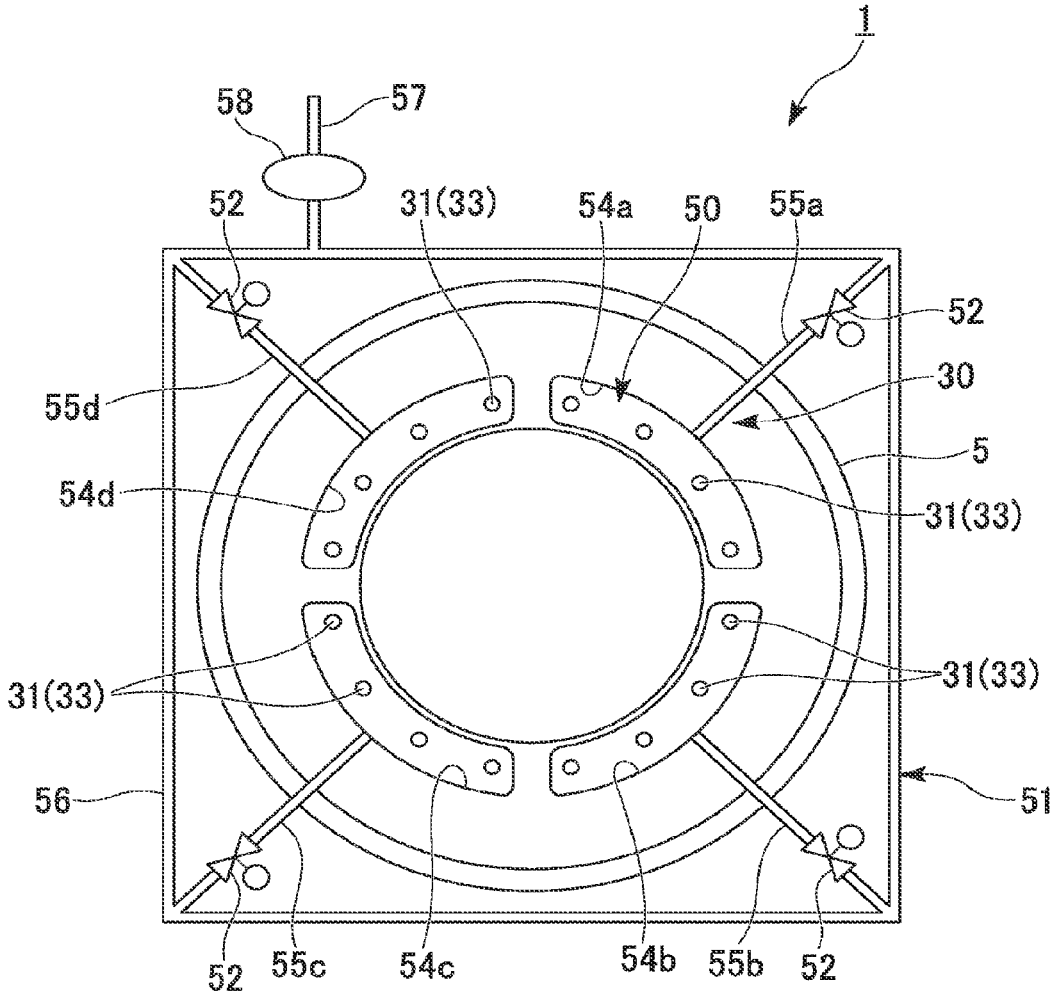
FIG. 8 is a cross sectional view taken along the line A to A in FIG. 1 and a block diagram which shows the other mode of FIG. 3.

In the above-described first embodiment, an explanation has been made for a case where the chamber 50 is constituted with a flow path or a tube body which is formed substantially in an annular shape so as to surround the impeller 3 and the shaft (rotating shaft) 2 and the chamber 50 is demarcated into the four divided chambers 54*a*, 54*b*, 54*c* and 54*d* by four partitions 53 arranged inside. However, the present invention shall not be restricted thereto. As shown in FIG. 8, for example, the four divided chambers 54*a* to 54*d* may be formed directly on the partition member 5*e* of the casing 5, in place of installing the partitions 53.

Further, the divided chambers and the partitions 53 which constitute the chamber 50 shall not be restricted to four units each. They may be provided at least in a plural number of two units. In this case, depending on the number of the divided chambers, the corresponding nozzles 31 are allowed to communicate with the divided chambers. Still further, a branching pipe is connected to each of the divided chambers, and the flow regulating valve 52 is attached to the branching pipe. In this case, the opening time and opening degree of the flow regulating valve 52 are determined depending on the number of divided chambers. Further, the divided chambers and the partitions 53 may not be necessarily disposed at regular intervals.

Second Embodiment

Next, an explanation will be made for the second embodiment of the present invention by referring to FIG. 9.

Figure 9:
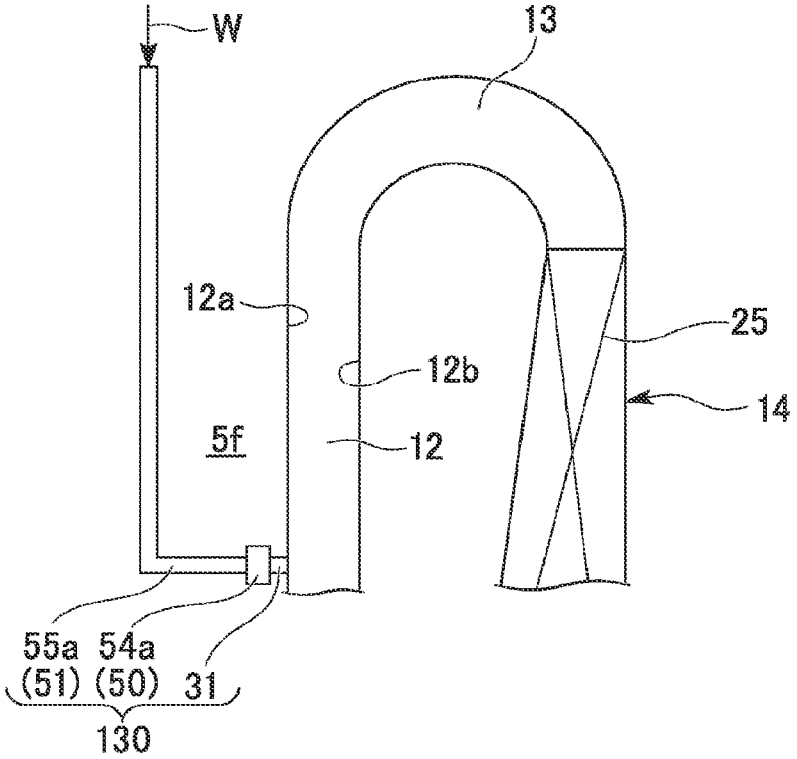
FIG. 9 is a view which shows a centrifugal compressor of a second embodiment of the present invention and a cross sectional view which shows major parts, in particular, of a washing liquid injection device.

FIG. 9 is a view which shows the second embodiment of the centrifugal compressor of the present invention. This drawing is a simplified sectional side view corresponding to FIG. 2 according to the first embodiment. The second embodiment will be explained by giving the same reference numerals to the same modes as those of the first embodiment (the same is applied to the following embodiments).

The second embodiment is similar to the first embodiment in basic structure, that is, that a centrifugal compressor 1 is a multiple-stage centrifugal compressor having six impellers, that the centrifugal compressor 1 is provided with a shaft (rotating shaft) 2 which rotates around the axis line O, an impeller 3 which is attached to the shaft 2 to compress a process gas (gaseous substance) G by utilizing centrifugal force, and a casing 5 which rotatably supports the shaft 2 and has a flow path 4 for allowing the process gas G to flow from upstream to downstream, in addition to a washing liquid injection device 130 which injects a washing liquid W to the flow path 4, that the washing liquid injection device 130 is provided with a plurality of nozzles 31 for injecting the washing liquid, a chamber 50 which communicates with each of the nozzles 31, a washing liquid supplying source (not illustrated) for supplying the washing liquid to the chamber 50 via a pipe 51, and a flow regulating valve 52 arranged along the pipe 51, and that the chamber 50 is in a state that the four divided chambers 54*a*, 54*b*, 54*c*, 54*d* are demarcated and each of the nozzles 31 communicates with each of the corresponding divided chambers 54*a* to 54*d* (the same is applied to the following embodiments).

In this case, as shown in FIG. 9, the second embodiment is different from the first embodiment in that in the first embodiment, the nozzle 31 (washing liquid injection device 30) is arranged on the diffuser rear wall 12*b*, whereas in the second embodiment, the nozzle 31 (washing liquid injection device 130) is arranged on the diffuser front wall 12*a*.

That is, in the second embodiment, the pipe 51, the chamber 50 and the nozzle 31 are disposed on the diffuser front wall 12*a* of the extension portion 5*f*, and a washing liquid injection port (nozzle port 33) of the nozzle 31 is arranged on an inner wall face of the diffuser front wall 12*a*. The above-described constitution makes it possible to inject the washing liquid W to the diffuser rear wall 12*b*.

Then, the washing liquid W is supplied to each of the divided chambers 54*a*, 54*b*, 54*c*, 54*d* which constitute the chamber 50, thereby sequentially washing a site corresponding to each of the divided chambers 54*a* to 54*d*, among the diffuser channel 12 and the return bend channel 13.

Therefore, according to the above-described second embodiment, it is possible to obtain the previously described same effect as that of the first embodiment. Further, no necessity for penetrating the pipe 51 through the return channel 14 (return vane 25) makes it possible to easily attach the washing liquid injection device 30 and also prevent the influence of the pipe 51 on a main flow.

Third Embodiment

Next, an explanation will be made for the third embodiment of the present invention by referring to FIG. 10.

Figure 10:
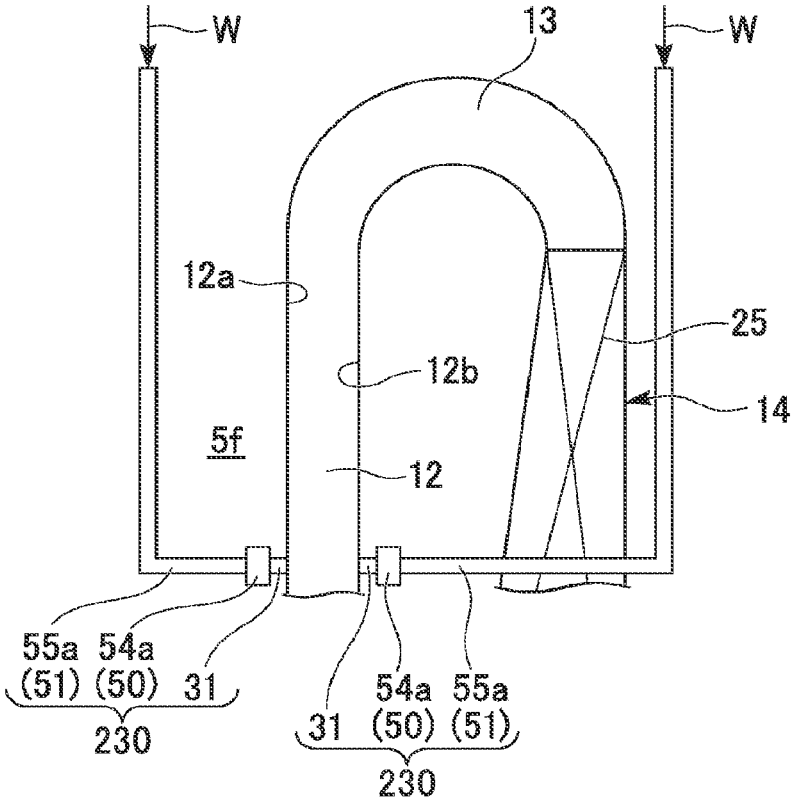
FIG. 10 is a view which shows a centrifugal compressor of a third embodiment of the present invention and a cross sectional view which shows major parts, in particular, of a washing liquid injection device.

FIG. 10 is a view which shows the third embodiment of the centrifugal compressor of the present invention and a simplified sectional side view which corresponds to FIG. 2 according to the first embodiment.

In this case, as shown in the drawing, the third embodiment is different from the first embodiment in that in the first embodiment, the nozzle 31 (washing liquid injection device 30) is arranged only on the diffuser rear wall 12*b*, whereas in the third embodiment, the nozzle 31 (washing liquid injection device 230) is arranged on the diffuser front wall 12*a*, in addition to the diffuser rear wall 12*b*.

That is, in the third embodiment, as with the first embodiment, the nozzle 31 is arranged on the diffuser rear wall 12*b* and arranged so as to inject the washing liquid W to the diffuser front wall 12*a*, and, as with the second embodiment, the nozzle 31 is also arranged on the diffuser front wall 12*a* and arranged so as to inject the washing liquid W toward the diffuser rear wall 12*b*.

The nozzle 31 arranged on the diffuser rear wall 12*b* and that arranged on the diffuser front wall 12*a* may be positioned in the circumferential direction so as to be similar in phase to each other or may be positioned so as to deviate from each other. For example, they may be arranged so as to deviate in phase by a half pitch from each other.

Therefore, according to the third embodiment, it is possible to obtain the previously described same effect as that of the first embodiment. Further, where the main flow is particularly large in flow velocity, in other words, where there is a fear that the washing liquid W injected from the nozzle 31 will not sufficiently spread in the span direction (the direction of the rotating shaft), on the diffuser front wall 12*a* and the diffuser rear wall 12*b*, the nozzles 31 are arranged respectively toward the other ends thereof. Accordingly, the washing liquid W is injected from each of the nozzles 31, thus making it possible to reliably spread the washing liquid W inside the flow path 4 all over in the span direction (direction of the rotating shaft).

Fourth Embodiment

Figure 11:
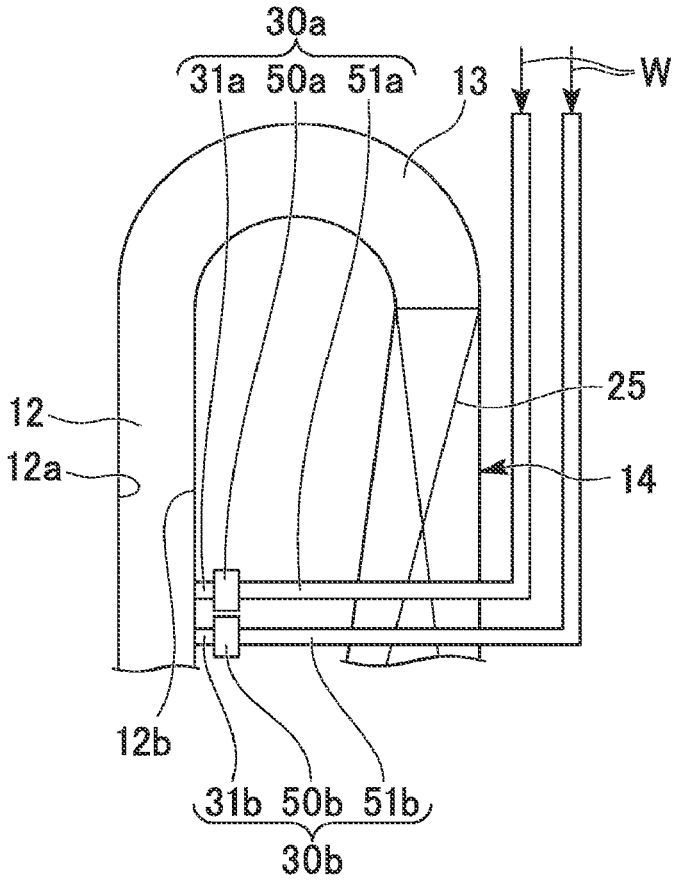
FIG. 11 is a view which shows a centrifugal compressor of a fourth embodiment of the present invention and a cross sectional view which shows major parts, in particular, of a washing liquid injection device.

FIG. 11 is a view which shows the fourth embodiment of the centrifugal compressor of the present invention and a simplified sectional side view corresponding to FIG. 2 according to the first embodiment.

In this case, the fourth embodiment is different from the first embodiment in that the first embodiment is provided with only one system of the washing liquid injection device 30 having many nozzles 31, the chamber 50 and the pipe 51, whereas the fourth embodiment is provided with two systems thereof.

That is, the fourth embodiment is provided with a first washing liquid injection device 30*a* similar in structure to the washing liquid injection device 30 of the first embodiment and a second washing liquid injection device 30*b* substantially similar in structure to the first washing liquid injection device 30*a*.

As shown in FIG. 11, the first washing liquid injection device 30*a* is provided with many nozzles 31*a*, a chamber 50*a* and a pipe 51*a*, and the second washing liquid injection device 30*b* is provided with many nozzles 31*b*, a chamber 50*b* and a pipe 51*b*. The chambers 50*a*, 50*b* of the two systems are respectively arranged in a concentric circle pattern so as to surround the impeller 3. The chamber 50*a* of the first washing liquid injection device 30*a* is arranged on the outer circumference, while the chamber 50*b* of the second washing liquid injection device 30*b* is arranged on the inner circumference.

Therefore, the nozzles 31*b* of the second washing liquid injection device 30*b* are given as the inner circumference nozzles 31*b* arranged on the impeller 3 side. The nozzles 31*a* of the first washing liquid injection device 30*a* are given as the outer circumference nozzles 31*a* arranged outside in the radial direction from the inner circumference nozzles 31*b*. Further, in the present embodiment, the inner circumference nozzles 31*b* and the outer circumference nozzles 31*a* are arranged so as to deviate by half a pitch from each other, with regard to the circumferential position of the impeller 3. Therefore, the washing liquid W is injected from both the nozzles 31*a*, 31*b*, thus making it possible to wash inside the flow path without causing irregularities in the circumferential direction of the impeller 3.

Further, in the present embodiment, the nozzle port of the inner circumference nozzle 31*b* (not illustrated) is smaller in diameter than the nozzle port of the outer circumference nozzle 31*a* (not illustrated).

Then, the first washing liquid injection device 30*a* and the second washing liquid injection device 30*b* are controlled by a control device (not illustrated) so that both devices are operated to inject the washing liquid W at the same time from both the nozzles 31*a*, 31*b*, or either device is operated to inject the washing liquid W from the nozzles of one system.

Therefore, in the centrifugal compressor of the fourth embodiment, the washing liquid W is allowed to collide and adhere over a wide range from the diffuser channel 12, the return channel 14 to the return vane 25. It is, thereby, possible to wash efficiently over a wide range of the entire flow path. It is also possible to wash over a wide range of the entire flow path in the radial direction as well.

Further, where the washing liquid W is restricted in feeding amount due to operating conditions of the centrifugal compressor, the centrifugal compressor is controlled in such a manner that, out of two systems of the washing liquid injection devices, only one system can be actuated to suppress the washing liquid W to a restricted amount.

In the fourth embodiment, an explanation has been made for an example where the two systems of washing liquid injection devices are disposed. As a matter of course, three or more systems of washing liquid injection devices may be disposed. Further, a flow rate is adjusted so as to be equal per unit time in each of the systems. However, the flow rate may be adjusted so as to be different in each of the systems.

Further, in the fourth embodiment, both the washing liquid injection devices 30*a*, 30*b* are arranged on the diffuser rear wall 12*b*. However, as shown in the second embodiment, the two systems of the washing liquid injection devices 30*a*, 30*b* may be both arranged on the diffuser front wall 12*a*. Alternatively, as shown in the third embodiment, the two systems of the washing liquid injection devices 30*a*, 30*b* may be arranged both on the diffuser rear wall 12*b* and on the diffuser front wall 12*a*.

Still further, in the fourth embodiment, the inner circumference nozzles 31*b* are made smaller in nozzle bore diameter than the outer circumference nozzles 31*a*. However, they may be equal in bore diameter. Alternatively, the outer circumference nozzles 31*a* may be made smaller in nozzle bore diameter than the inner circumference nozzles 31*b*.

In addition, the inner circumference nozzles 31*b* and the outer circumference nozzles 31*a* may be equal or different in number.

Fifth Embodiment

Next, an explanation will be made for the fifth embodiment of the present invention by referring to FIG. 12 to FIG. 16.

Figure 12:
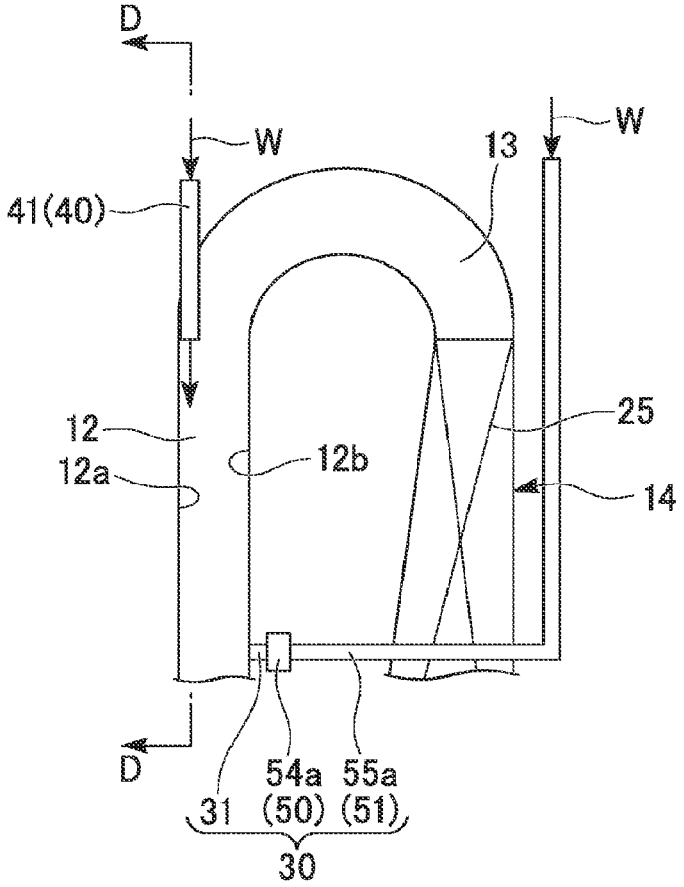
FIG. 12 is a view which shows a centrifugal compressor of a fifth embodiment of the present invention and a cross sectional view which shows major parts, in particular, of a washing liquid injection device.
Figure 13:
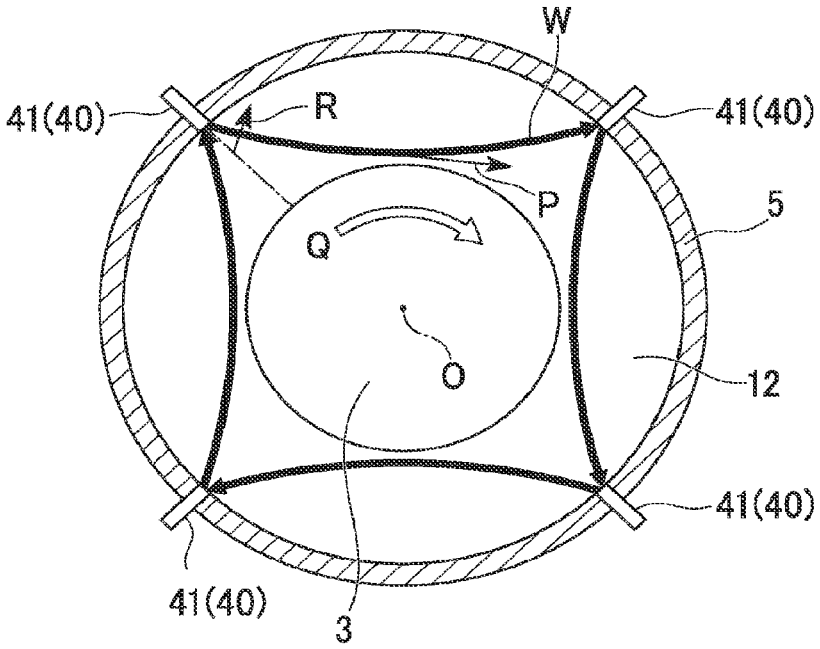
FIG. 13 is a cross sectional view taken along the line D to D in FIG. 11.

FIG. 12 is a view which shows the fifth embodiment of the centrifugal compressor of the present invention and a simplified sectional side view corresponding to FIG. 2 according to the first embodiment. FIG. 13 is a cross sectional view taken along the line D to D in FIG. 12.

In this case, as shown in FIG. 12 and FIG. 13, the fifth embodiment is different from the first embodiment in that in the first embodiment, the washing liquid injection device 30 has many nozzles 31, the chamber 50 and the pipe 51 are arranged on the diffuser rear wall 12*b*, whereas in the fifth embodiment, another washing liquid injection device 40 is arranged in addition to a washing liquid injection device 30, and the washing liquid injection device 30 and the washing liquid injection device 40 are used to constitute the washing liquid injection device of the present invention.

The washing liquid injection device 40 is provided with a nozzle (second nozzle) 41 and a washing liquid supplying source (not illustrated) for supplying a washing liquid to the nozzle 41 via a pipe (not illustrated) and others. In FIG. 13, description of the shaft 2 is omitted.

The nozzle 41 is arranged outside in the radial direction of the diffuser channel 12 and also along the radial direction so as to face to the diffuser channel 12. Then, for example, the nozzle 41 is arranged so as to penetrate through the casing 5.

Further, the nozzle 41 is arranged along the diffuser front wall 12*a*. And, the plurality of nozzles 41 are arranged at regular intervals in the circumferential direction (for example, four of them are arranged so as to correspond to the divided chambers 54*a* to 54*d* in the fifth embodiment).

That is, each of the nozzles 41 is arranged in such a manner that an injection direction of the washing liquid W indicated by the arrow P is substantially orthogonal to a fluid flowing direction (the direction indicated by the arrow R in FIG. 13) at a position opposing each of the nozzles 41 of the impeller 3 (a position which is shortest in distance). Further, each of the nozzles 41 is arranged in such a manner that the injection direction of the washing liquid W indicated by the arrow P in FIG. 13 is the same as the rotating direction of the impeller 3 indicated by the arrow Q and also outside the impeller 3 without contact with the impeller 3.

Figure 14:
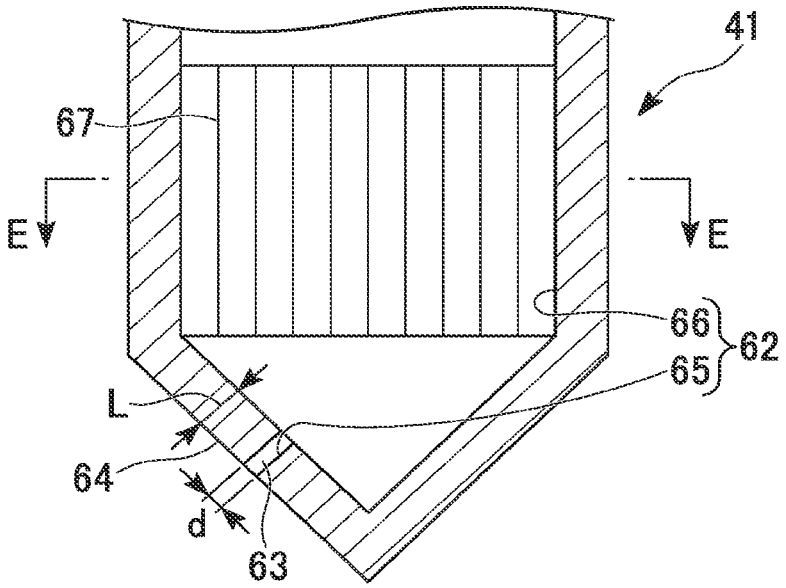
FIGS. 14 (*a*) and 14(*b*) are brief constitutions of a nozzle of the fifth embodiment of the present invention.
Figure 14B:
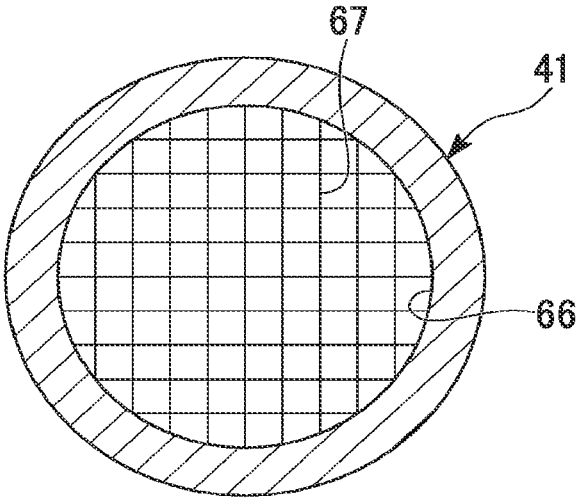
Figure 15:
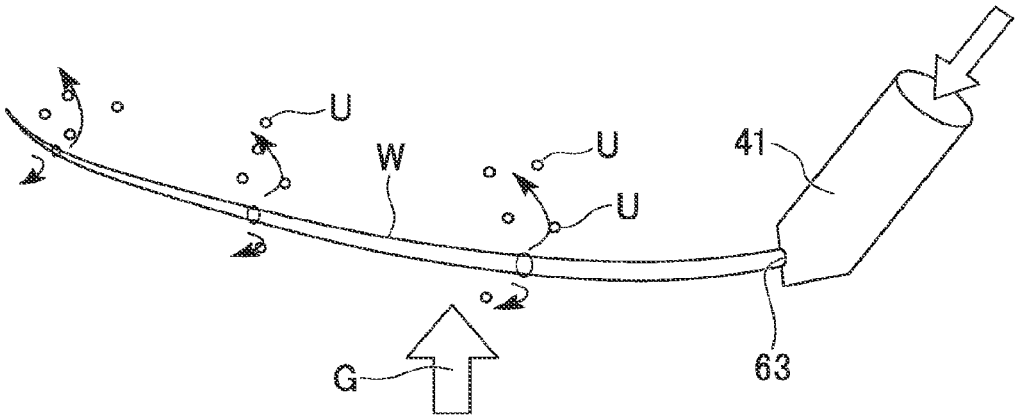
FIG. 15 is a schematic view which shows a state of a washing liquid of the fifth embodiment of the present invention.

FIG. 14 schematically shows a constitution of the nozzle 41, more specifically, (a) is a cross sectional view and (b) is a cross sectional view taken along the line E to E in (a). FIG. 15 is a schematic view which shows a state that the washing liquid W flows in a liquid columnar shape.

In this case, as shown in FIG. 14(*a*) and FIG. 14(*b*), the nozzle 41 is provided, for example, with an inner hole 62 which leads to a washing liquid supplying source (not illustrated) and a nozzle port 63 which communicates with the inner hole 62 to inject the washing liquid W. An inclined face (or a curved face) 64 is formed at the leading end of the nozzle 41 and the nozzle port 63 is formed on the inclined face 64.

The inner hole 62 is provided with a linear rectifying portion 65 which is opened at the nozzle port 63 and equal in inner diameter to the nozzle port 63 and a large diameter portion 66 which communicates with the rectifying portion 65 and is formed so as to be larger in inner diameter than the rectifying portion 65.

In the example shown in FIG. 14(*a*), an inclined face (or a curved face) is also formed at the leading end of the large diameter portion 66 so as to correspond to the inclined face 64 at the leading end. In addition, one end of the rectifying portion 65 is opened on the inclined face.

The flow path length L of the rectifying portion 65 is set to be at least three times the inner diameter d of the nozzle port 63.

To be more specific, the inner diameter d of the nozzle port 63 is set from about 0.1 mm to about 10 mm and preferably from 1 mm or more to 5 mm or less. As described above, the rectifying portion 65 is provided, the flow path length of which is at least three times the inner diameter d of the nozzle port 6, thereby, the washing liquid W injected from the nozzle 61 flows in a continuous liquid columnar shape as shown in FIG. 15.

That is, the washing liquid W which flows through the inner hole 62 of the nozzle 61 is injected from the nozzle port 63 in a state of being rectified by the rectifying portion 65. Therefore, substantially no gyration vector is imparted to the injected washing liquid W. As a result, the injected washing liquid W does not cause atomization resulting from the fact that the flow of the fluid is cut off by the gyration vector but flows in a continuous liquid columnar shape as shown in FIG. 15.

However, after being injected in a liquid columnar shape, the washing liquid W is subjected to shear force resulting from the flow of a main flow (flow of the process gas G), and some of the washing liquid W is atomized to gradually develop into droplets U.

Further, as shown in FIG. 14(*a*), it is preferable that the rectifying plate 67 is arranged at the large diameter portion 66.

As shown in FIG. 14(*b*), the rectifying plate 67 is that which is constituted with many plates arranged vertically and horizontally to give a lattice structure. It is noted that a length of one side of a square formed between the plates arranged vertically and horizontally is set to be greater than the inner diameter d of the nozzle port 63. The above-constituted rectifying plate 67 is arranged at the large diameter portion 36, by which no gyration vector is imparted but only a direct vector is imparted to the washing liquid W which flows into the rectifying portion 65. Therefore, the washing liquid injected from the nozzle 31 flows further through the rectifying portion 65 and more favorably continues and forms into a liquid columnar shape as shown in FIG. 15.

In the above-described constitution, the washing liquid W injected from the nozzle port 63 of the washing liquid injection device 40 flows temporarily inside in the radial direction of the diffuser channel 12. In addition, thereafter, the washing liquid W is pushed back by the main flow, as with a case shown in FIG. 7, passes through the return bend channel 13 downstream from the diffuser channel 12 and flows to the return vane 25 side inside the return channel 14.

Therefore, the washing liquid W injected from the washing liquid injection device 30 passes a relatively long distance and arrives at the return vane 25 side taking a relatively long time. Then, the droplets U which are subjected to shear force resulting from the flow of the main flow (flow of the process gas G) and gradually atomized collide against and adhere to inner wall faces of the diffuser channel 12 and the return bend channel 13, thereby washing the inner wall faces. Further, after moving into the flow of the main flow to arrive at the return channel 14 and the return vane 25 side, the droplets U collide against and adhere to the return vane 25 and inner wall face of the return channel 14, thereby washing them.

Further, as shown in FIG. 13, the inject ion direction P of the washing liquid W is the same as the rotating direction Q of the impeller 3 and also intersects substantially at right angles with the flow of a fluid in a right-angled cross section of the rotating shaft. Therefore, the washing liquid W is subjected to the flow of a main flow along the rotating direction of the impeller 3 and moves into the main flow.

That is, the washing liquid W intersects substantially at right angles with the flowing direction of the fluid in a right-angled cross section of the rotating shaft. Thereby, the washing liquid W flows together with the flow of the main flow so as to be pushed by the main flow. As described above, when moving into the flow of the main flow, the washing liquid W flows in a curved direction so as to come closer to the flowing direction of the main flow from the injection direction P. As a result, the washing liquid W flows over a wider range in the rotating direction Q of the impeller 3.

Figure 16:
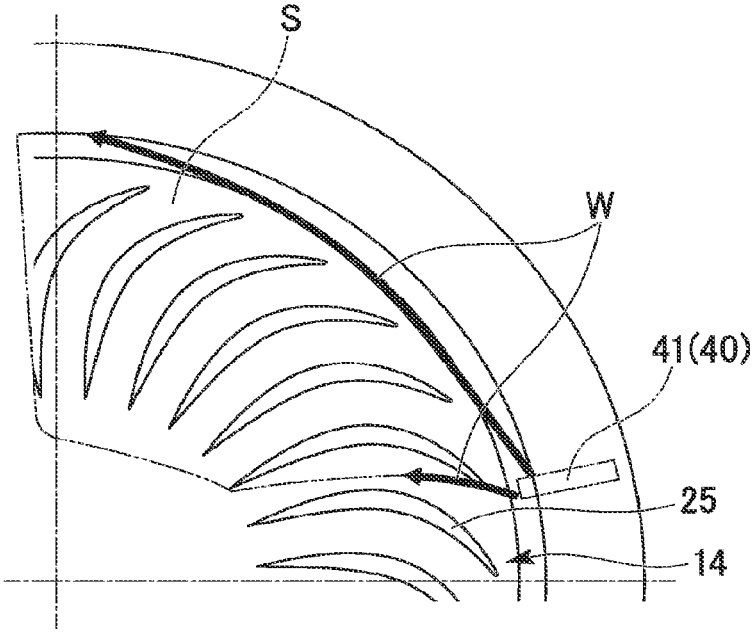
FIG. 16 is a schematic view which shows a state of the washing liquid of the fifth embodiment of the present invention.

Then, after passing a relatively long distance taking a relatively long time as described above, the washing liquid W arrives at the return vane 25 side, and, the gradually atomized droplets U collide against and adhere to the return vane 25 and the inner wall face of the return channel 14. Thus, as shown in FIG. 16, the washing liquid W collides and adheres within a wide range S of the return vane 25 side.

Therefore, according to the above-described fifth embodiment, it is possible to obtain the same effect as that of the first embodiment.

Further, the washing liquid W is allowed to collide and adhere within a wide range from the diffuser channel 12, the return channel 14 to the return vane 25 by using the nozzles 41 (second nozzles) of the washing liquid injection device 40 as well. It is, thereby, possible to wash over a wide range of the entire flow path.

Still further, the injection direction of the washing liquid W is the same as the rotating direction of the impeller 3 and also intersects substantially at right angles with the flowing direction of the fluid in a right-angled cross section of the shaft (rotating shaft) 2 at a position of the impeller 3 opposing the washing liquid injection device. Therefore, the washing liquid W is subjected to the flow of the main flow along the rotating direction of the impeller 3 and moves into the main flow. Further, the washing liquid W passes a relatively long distance and arrives at the return vane 25 side. Thereby, the washing liquid W collides and adheres within a wide range from the diffuser channel 12, the return channel 14 to the return vane 25. It is, thereby, possible to wash over a wide range of the entire flow path.

In addition, the nozzles 31 (first nozzles) of the washing liquid injection device 30 are arranged on the diffuser rear wall 12*b* and arranged in such a manner that the washing liquid W is injected to the diffuser front wall 12*a*, and the nozzles (second nozzles) 41 of the washing liquid injection device 40 are arranged along the diffuser front wall 12*a*. Therefore, the washing liquid can be injected efficiently in the span direction and in the circumferential direction by using these nozzles 31, 41. It is, thereby, possible to wash over a wide range of the entire flow path.

This is due to the fact that in the vicinity of an outlet of the impeller 3, the main flow is greater in flow velocity on the diffuser rear wall 12*b* side, the washing liquid injected from the nozzles 31 is atomized accordingly in an accelerated manner and more easily spread in the span direction (the direction of the rotating shaft). On the other hand, the main flow is relatively slow in flow velocity on the diffuser front wall 12*a* side and accordingly more easily spread in the circumferential direction.

Incidentally, in the above-described embodiments, an explanation has been made for a case where the nozzles 31 of the washing liquid injection devices 30, 30*a*, 30*b*, 130, 230 are arranged in such a manner that the injection direction of the washing liquid W is approximately in parallel with the rotating shaft (shaft 2) of the impeller 3. However, the present invention shall not be restricted to the above case. The injection direction of the washing liquid W may be inclined upstream or downstream from the side of the main flow or may be inclined inside or outside in the radial direction of the flow path, whenever necessary.

Further, in the fifth embodiment, an explanation has been made for a case where the washing liquid injection device 40 is arranged in addition to the washing liquid injection device 30 of the first embodiment. However, the present invention shall not be restricted thereto. The washing liquid injection device 40 may be arranged, in addition to the washing liquid injection device 130 of the second embodiment, the washing liquid injection device 230 of the third embodiment, and the washing liquid injection devices 30*a*, 30*b* of the fourth embodiment.

Still further, in the above-described fifth embodiment, the nozzles 31 (first nozzles) of the washing liquid injection device 30 are arranged on the diffuser rear wall 12*b* and also the nozzles 41 (second nozzles) of the washing liquid injection device 40 are arranged along the diffuser front wall 12*a*. However, the present invention shall not be restricted thereto. In contrast, the nozzles 31 (first nozzles) of the washing liquid injection device 30 may be arranged on the diffuser front wall 12*a*, and the nozzles 41 (second nozzles) of the washing liquid injection device 40 may be arranged along the diffuser rear wall 12*b*.

Then, in the above-described fifth embodiment, an explanation has been made for a case where four nozzles 41 are arranged so as to correspond to the divided chambers 54*a* to 54*d* of the chamber 50. However, the present invention shall not be restricted thereto. The number of the nozzles 41 to be disposed may be changed depending on the number of the divided chambers, or each of the divided chambers 54*a* to 54*d* may be provided with two or more nozzles 41. Further, in the fifth embodiment, the nozzles 41 are arranged annularly at regular intervals. However, they may not be necessarily arranged at regular intervals.

Further, in the above-described embodiments, an explanation has been made for a case where the centrifugal compressor is a multiple-stage centrifugal compressor which is provided with six impellers. However, the present invention shall not be restricted thereto. The washing liquid injection devices 30, 30*a*, 30*b*, 40, 130, 230 may also be applicable to a single-stage centrifugal compressor.

Sixth Embodiment

Next, an explanation will be made for the sixth embodiment of the present invention by referring to FIG. 17 and FIG. 18.

Figure 17:
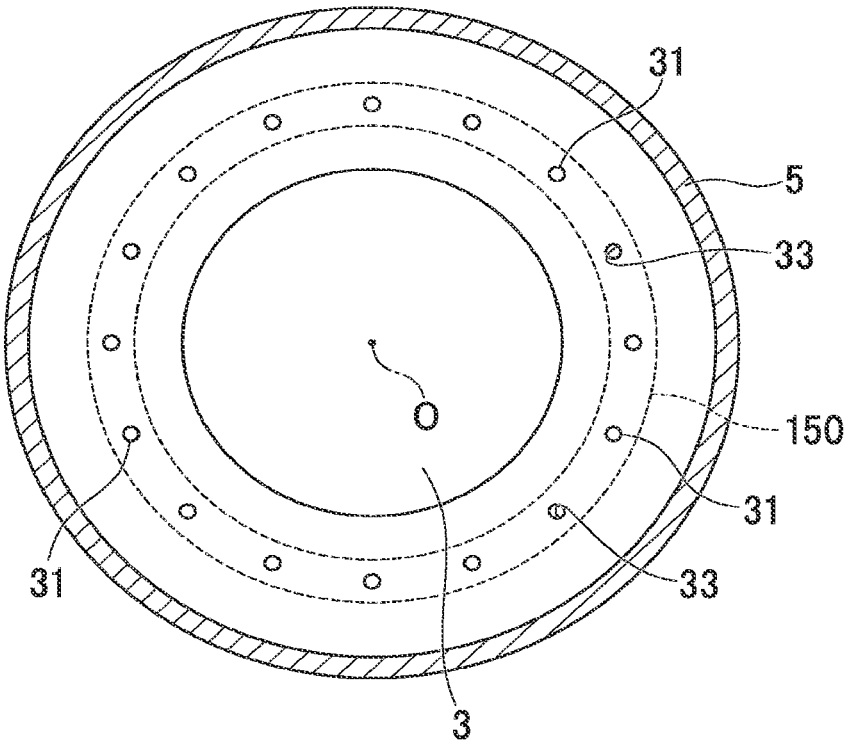
FIG. 17 is a view which shows a centrifugal compressor of a sixth embodiment of the present invention and a cross sectional view which shows major parts, in particular a chamber on a planar surface.

FIG. 17 is a view which shows the sixth embodiment of the centrifugal compressor of the present invention and a cross sectional view corresponding to FIG. 3 according to the first embodiment. FIG. 18 is a simplified sectional side view corresponding to FIG. 2 according to the first embodiment.

In this case, in the first embodiment, the chamber 50 is demarcated into four divided chambers 54*a*, 54*b*, 54*c*, 54*d* by the four partitions 53. In the sixth embodiment, however, a chamber 150 is an endless annular flow path which is formed inside a casing 5 so as to surround an impeller 3 and a shaft 2. In the present embodiment, a washing liquid injection device 330 is similar to the washing liquid injection device 30 of the first embodiment excluding the structure of the chamber 150.

The chamber 150 is attached, in a state of being buried, to a partition member 5*e* attached integrally to the casing 5 (refer to FIG. 2).

Figure 18:
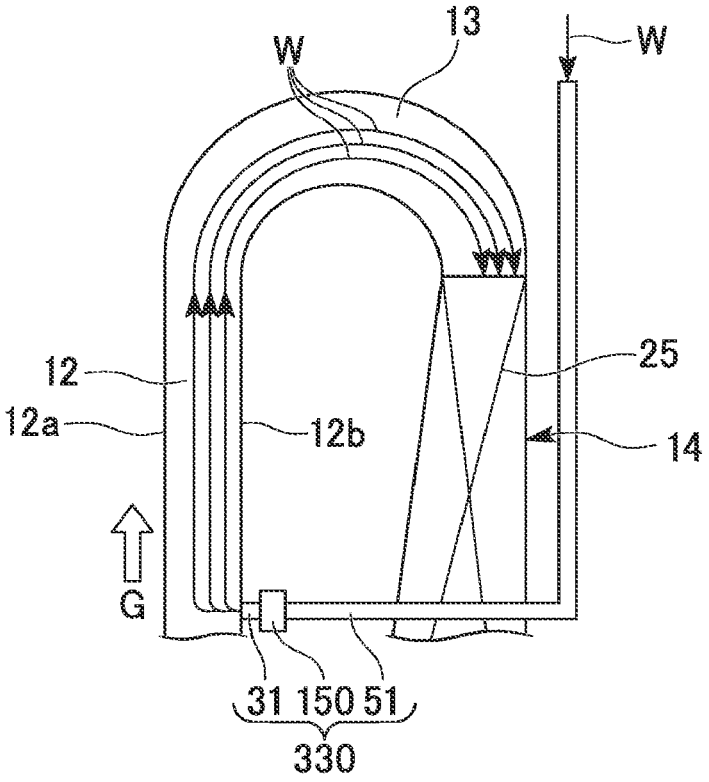
FIG. 18 is a cross sectional view which shows major parts of a washing liquid injection device used in a centrifugal compressor of the sixth embodiment of the present invention.

As shown in FIG. 18, a plurality of nozzles 31 are arranged on the chamber 150 so as to be orthogonal to the inner wall face of a diffuser rear wall 12*b* toward the inner wall face thereof. Each of the nozzles 31 is provided with an inner hole 32 which leads to a washing liquid supplying source (not illustrated) and a nozzle port 33 which communicates with the inner hole 32 to inject a washing liquid W. In addition, each of the nozzles 31 is arranged so as to be approximately in parallel with the shaft (rotating shaft) 2 from the diffuser rear wall 12*b* to a diffuser front wall 12*a*, thereby injecting the washing liquid W into a diffuser channel 12.

In the above-constituted washing liquid injection device 330, the washing liquid injection device 30 is constituted with the plurality of nozzles 31, the single chamber 150 communicating with each of the nozzles 31 and a pipe 51. Therefore, the washing liquid W is supplied from the supplying source of the washing liquid to the chamber 150, by which the washing liquid W can be supplied all together to the nozzles 31 via the chamber 150 and injected. Therefore, the washing liquid injection device 30 can be made simple in structure.

Further, the chamber 150 is formed annularly so as to surround the impeller 3. Thus, many nozzles 31 are arranged on the annularly formed chamber 150 so as to be apart from each other in the circumferential direction. Thereby, the washing liquid W will flow widely in the circumferential direction of the impeller 3, thus making it possible to wash over a wide range of the entire flow path in the circumferential direction of the impeller 3 as well.

Figure 19:
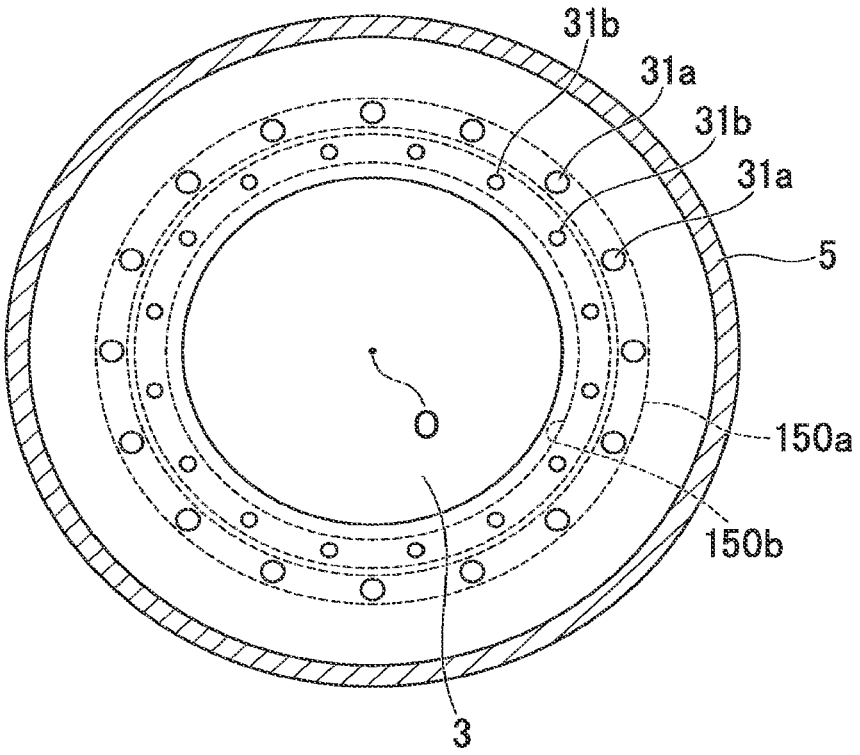
FIG. 19 is a view which shows a modification example of the centrifugal compressor of the sixth embodiment of the present invention and a cross sectional view which shows major parts, in particular, a chamber when viewed from above.
Figure 20:
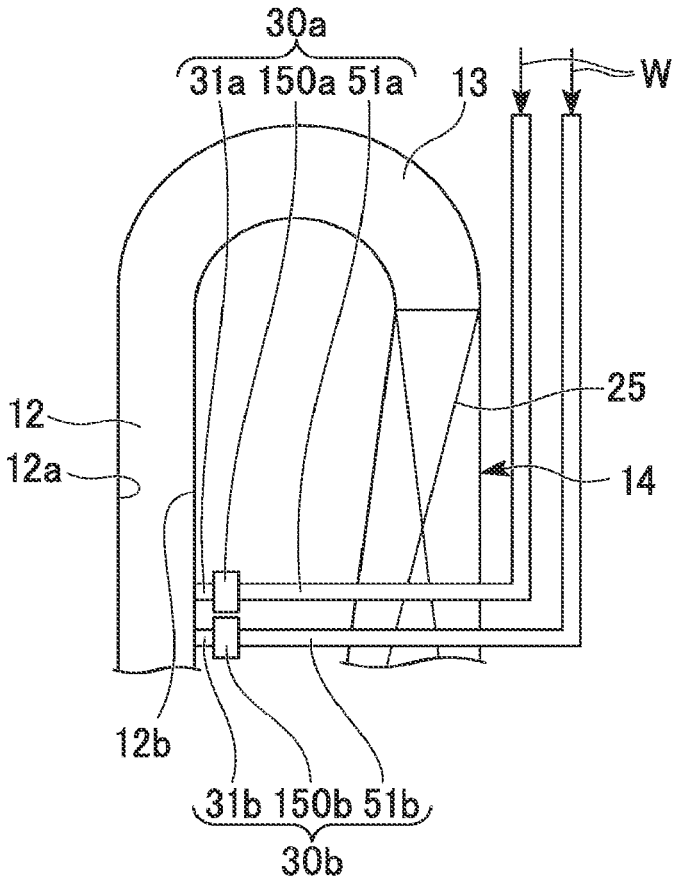
FIG. 20 is a cross sectional view which shows major parts of a washing liquid injection device used as the modification example of the centrifugal compressor of the sixth embodiment of the present invention.

In the above-described sixth embodiment, an explanation has been made for a case where the chamber 150 is an endless annular flow path which is formed inside the casing 5 so as to surround the impeller 3 and the shaft 2. However, the present invention shall not be restricted to this case. The chamber 150 may be, for example, a tube body which is arranged inside the casing 5 so as to surround the impeller 3 and the shaft 2. Further, as shown in FIG. 19 and FIG. 20, two systems of the chambers 150*a*, 150*b*, each of which is an endless annular flow path, may be arranged in a concentric circle pattern so as to surround the impeller 3. In this case, the washing liquid injection devices 30*a*, 30*b* of the fourth embodiment are adopted as a washing device, excluding the chamber.

On the other hand, in the sixth embodiment, the washing liquid injection device 330 is constituted with the nozzles 31, the chamber 150 and the pipe 51. However, the present invention shall not be restricted thereto. The washing liquid injection device 330 may be constituted, for example, by directly connecting the nozzles 31 to the pipe 51 in place of installing the chamber 150.

Further, in the sixth embodiment, an explanation has been made for a case where the washing liquid injection device 330 similar in structure to the washing liquid injection device 30 of the first embodiment is adopted, excluding the chamber 150. However, the present invention shall not be restricted thereto. The washing liquid injection device 40, in addition to the washing liquid injection device 130 of the second embodiment, the washing liquid injection device 230 of the third embodiment, and the washing liquid injection devices 30*a*, 30*b* of the fourth embodiment may be adopted.

In the above-described sixth embodiment, the chamber 150 (50*a*, 50*b*) is formed all over on the circumference. However, the present invention shall not be restricted thereto. The chamber 150 (50*a*, 50*b*) which is divided into plural parts in the circumferential direction may be used.

In the above-described individual embodiments, an explanation has been made for a multiple-stage centrifugal compressor. The present invention shall not be restricted thereto but may also be applicable to a single-stage centrifugal compressor.

An explanation has been made above for preferred embodiments of the present invention, to which the present invention shall not be, however, restricted. The present invention may be subjected to addition, omission, and replacement of the constitution, and other modifications within a scope not departing from the gist of the present invention. The present invention shall not be restricted to the above description but will be restricted only by the scope of the attached claims.

INDUSTRIAL APPLICABILITY

The present invention relates to a centrifugal compressor that is provided with a casing, a rotating shaft which is supported inside the casing, an impeller which is arranged on the rotating shaft and rotates to compress a fluid, and a washing liquid injection device which injects a washing liquid into a flow path formed by the impeller and the casing. The washing liquid injection device is provided with a plurality of nozzles which are arranged along a circumferential direction of the rotating shaft to inject the washing liquid into the flow path and a plurality of chambers which communicate with each corresponding nozzle among the plurality of nozzles to supply the washing liquid to the corresponding nozzle. According to the present invention, it is possible to wash the entire flow path efficiently even where the washing liquid is restricted in flow rate.

DESCRIPTION OF REFERENCE NUMERALS

1: centrifugal compressor
2: shaft (rotating shaft)
3: impeller
4: flow path
5: casing
5*e*: partition member
5*f*: extension portion
12: diffuser channel (diffuser)
12*a*: diffuser front wall
12*b*: diffuser rear wall
13: return bend channel
14: return channel
30, 40, 130, 230, 330: washing liquid injection device
31: nozzle (first nozzle)

33, 63: nozzle port
41: nozzle (second nozzle)
50, 150: chamber
51: pipe
52: flow regulating valve
54*a* to 54*d*: divided chamber
55*a* to 55*d*: branching pipe
56: coupling pipe
57: bypass
G: process gas
P: injection direction
Q: rotating direction of impeller
W: washing liquid

The invention claimed is:

1. A centrifugal compressor comprising:
a casing;
a rotating shaft which is supported inside the casing;
an impeller which is arranged on the rotating shaft and rotates to compress a fluid; and
a washing liquid injection device which injects a washing liquid into a flow path formed by the impeller and the casing, wherein
the washing liquid injection device is arranged on one of a diffuser front wall and a diffuser rear wall which form a diffuser in the flow path to inject the washing liquid to another of the diffuser front wall and the diffuser rear wall,
the washing liquid injection device is provided along a circumferential direction of the rotating shaft with a plurality of nozzles which inject the washing liquid, and
the plurality of nozzles include an inner circumference nozzle and an outer circumference nozzle which is arranged outside in a radial direction from the inner circumference nozzle.

2. The centrifugal compressor according to claim 1, wherein
the inner circumference nozzle and the outer circumference nozzle are arranged so as to be different in phase from each other.

3. The centrifugal compressor according to claim 1, wherein
a bore diameter of the inner circumference nozzle is smaller than that of the outer circumference nozzle.

4. A centrifugal compressor comprising:
a casing;
a rotating shaft which is supported inside the casing;
an impeller which is arranged on the rotating shaft and rotates to compress a fluid; and
a washing liquid injection device which injects a washing liquid into a flow path formed by the impeller and the casing, wherein
the washing liquid injection device is arranged on one of a diffuser front wall and a diffuser rear wall which form a diffuser in the flow path to inject the washing liquid to another of the diffuser front wall and the diffuser rear wall, and
the washing liquid injection device is provided with
a first nozzle which is arranged on at least one of the diffuser front wall and the diffuser rear wall which form the diffuser in the flow path and arranged so as to inject the washing liquid toward another of the diffuser front wall and the diffuser rear wall, and
a second nozzle which is arranged outside in a radial direction of the diffuser toward an inside in the radial direction of the diffuser in the flow path and which is arranged in such a manner that at least one of directions at which the washing liquid is injected is the same as a rotating direction of the impeller and also intersects approximately at right angles in a direction at which the fluid flows in a right-angled cross section of the rotating shaft at a position of the impeller opposing the washing liquid injection device.

5. The centrifugal compressor according to claim 4, wherein
the first nozzle is arranged on the diffuser rear wall and also arranged so as to inject the washing liquid to the diffuser front wall, and
the second nozzle is arranged along the diffuser front wall.

6. The centrifugal compressor according to claim 1, wherein
the washing liquid injection device is provided with at least one chamber which communicates with each of the plurality of nozzles.

7. The centrifugal compressor according to claim 6, wherein
the chamber is formed in a substantially annular shape so as to surround the rotating shaft.

* * * * *